US009259658B2

(12) United States Patent
Hillis et al.

(10) Patent No.: US 9,259,658 B2
(45) Date of Patent: Feb. 16, 2016

(54) SQUEEZABLE MUSICAL TOY WITH LOOPING AND DECAYING SCORE AND VARIABLE CAPACITANCE STRESS SENSOR

(75) Inventors: W. Daniel Hillis, Encino, CA (US); Russel Howe, Montrose, CA (US)

(73) Assignee: APPLIED INVENTION, LLC, Glendale, CA (US)

( * ) Notice: Subject to any disclaimer, the term of this patent is extended or adjusted under 35 U.S.C. 154(b) by 638 days.

(21) Appl. No.: 13/407,279

(22) Filed: Feb. 28, 2012

(65) Prior Publication Data

US 2012/0220187 A1 Aug. 30, 2012

Related U.S. Application Data

(60) Provisional application No. 61/447,516, filed on Feb. 28, 2011.

(51) Int. Cl.

| | |
|---|---|
| ***A63H 3/28*** | (2006.01) |
| ***A63H 5/00*** | (2006.01) |
| ***G10H 1/055*** | (2006.01) |
| ***G10H 1/26*** | (2006.01) |

(52) U.S. Cl.

CPC .. *A63H 3/28* (2013.01); *A63H 5/00* (2013.01); *G10H 1/0551* (2013.01); *G10H 1/26* (2013.01); *G10H 2230/055* (2013.01)

(58) Field of Classification Search

CPC ..... A63H 3/28; A63H 5/00
USPC ..... 446/175, 297, 397, 404
See application file for complete search history.

(56) References Cited

U.S. PATENT DOCUMENTS

| | | | | | |
|---|---|---|---|---|---|
| 3,977,292 | A | * | 8/1976 | Favilli et al. | 84/470 R |
| 4,350,070 | A | * | 9/1982 | Bahu | 84/612 |
| 5,099,740 | A | * | 3/1992 | Minamitaka | 84/651 |
| 5,146,834 | A | * | 9/1992 | Izumisawa et al. | 84/607 |
| 5,478,268 | A | * | 12/1995 | Au | 446/227 |
| 5,637,821 | A | * | 6/1997 | Izumisawa et al. | 84/604 |
| 5,668,333 | A | * | 9/1997 | Horton et al. | 84/470 R |
| 5,902,946 | A | * | 5/1999 | Kogure et al. | 84/477 R |
| 5,944,533 | A | * | 8/1999 | Wood | 434/322 |
| 5,997,304 | A | * | 12/1999 | Wood | 434/169 |

(Continued)

OTHER PUBLICATIONS

Fuller, L , "MEMS Capacitor Sensor Laboratory", Microelectronic Engineering, Rochester Institute of Technology, Apr. 9, 2008, 18 pages.

*Primary Examiner* — Melba Bumgarner
*Assistant Examiner* — Joseph B Baldori
(74) *Attorney, Agent, or Firm* — Michael A. Glenn; Perkins Coie LLP

(57) ABSTRACT

An enhanced toy produces repeating, decaying notes in response to applied pressure. The tone of each note is determined, based on the location at which a user applies pressure. The initial amplitude of each note is proportional to the intensity, as measured by a stress sensor. The toy periodically repeats each note, attenuating the amplitude of each successive repetition by a decay factor. The toy may alter the notes associated with each of a plurality of locations. For example, if all currently repeating notes have decayed below a predetermined threshold, the currently available set of notes may be exchanged for a new set of notes, e.g. with different tones or timbres. The stress sensors may comprise flexible capacitors within the toy. As the user applies pressure, the geometry of one or more capacitors deform, altering the measured capacitance, through which the intensity of the applied pressure is determined.

18 Claims, 17 Drawing Sheets

(56) References Cited

U.S. PATENT DOCUMENTS

| | | | | |
|---|---|---|---|---|
| 6,053,797 | A * | 4/2000 | Tsang et al. | 446/297 |
| 6,074,212 | A * | 6/2000 | Cogliano | 434/159 |
| 6,079,985 | A * | 6/2000 | Wohl et al. | 434/319 |
| 6,132,281 | A * | 10/2000 | Klitsner et al. | 446/75 |
| 6,193,579 | B1 * | 2/2001 | Mak | 446/297 |
| 6,247,934 | B1 * | 6/2001 | Cogliano | 434/159 |
| 6,259,006 | B1 * | 7/2001 | Parienti | 84/171 |
| 6,353,174 | B1 * | 3/2002 | Schmidt et al. | 84/609 |
| 6,409,511 | B2 * | 6/2002 | Cogliano | 434/159 |
| 6,454,627 | B1 * | 9/2002 | Mak | 446/369 |
| 6,463,257 | B1 * | 10/2002 | Wood | 434/308 |
| 6,506,969 | B1 * | 1/2003 | Baron | 84/609 |
| 6,585,554 | B1 * | 7/2003 | Hewitt et al. | 446/146 |
| 6,595,780 | B2 * | 7/2003 | Singh et al. | 434/258 |
| 6,607,388 | B2 * | 8/2003 | Cogliano | 434/159 |
| 6,882,824 | B2 * | 4/2005 | Wood | 434/308 |
| 7,029,361 | B2 * | 4/2006 | Seibert et al. | 446/327 |
| 7,183,478 | B1 * | 2/2007 | Swearingen | 84/609 |
| 7,420,114 | B1 * | 9/2008 | Vandervoort | 84/613 |
| 7,598,449 | B2 * | 10/2009 | Sullivan | 84/646 |
| 7,709,725 | B2 * | 5/2010 | Toledano et al. | 84/615 |
| 7,754,955 | B2 * | 7/2010 | Egan | 84/600 |
| 8,398,451 | B2 * | 3/2013 | Wolfe et al. | 446/175 |
| 8,545,283 | B2 * | 10/2013 | Richter | 446/297 |
| 2001/0041496 | A1 * | 11/2001 | Smirnov | 446/297 |
| 2005/0034591 | A1 * | 2/2005 | Chang | 84/730 |
| 2006/0130636 | A1 * | 6/2006 | Toledano et al. | 84/600 |
| 2006/0286895 | A1 * | 12/2006 | Thomson et al. | 446/297 |
| 2007/0042672 | A1 * | 2/2007 | Tawil | 446/369 |
| 2009/0114079 | A1 * | 5/2009 | Egan | 84/477 R |
| 2009/0209170 | A1 * | 8/2009 | Richter | 446/297 |
| 2009/0314157 | A1 * | 12/2009 | Sullivan | 84/646 |
| 2011/0065354 | A1 * | 3/2011 | Wolfe et al. | 446/297 |
| 2012/0220187 | A1 * | 8/2012 | Hillis et al. | 446/297 |

* cited by examiner

SQUEEZABLE MUSICAL TOY WITH LOOPING AND DECAYING SCORE AND VARIABLE CAPACITANCE STRESS SENSOR

CROSS REFERENCE TO RELATED APPLICATION AND CLAIM FOR PRIORITY

This Application claims priority to U.S. Provisional Patent Application No. 61/447,516, entitled Musical Toy, filed 28 Feb. 2011, which is incorporated herein in its entirety by this reference thereto.

FIELD OF THE INVENTION

The present invention relates generally to the field of interactive structures and associated processes. More particularly, the present invention relates to systems, structures, and processes for musical devices, such as but not limited to toys.

BACKGROUND OF THE INVENTION

The dramatic reduction in the cost and size of microcontrollers has led to their widespread adoption throughout the toy industry. In particular, many stuffed toys are now equipped with microcontrollers that provide an interactive experience for the owner. In many instances, the stuffed toy is further equipped with devices such as contact switches, e.g. momentary switches, or pressure sensors that can detect if and where a user is contacting the toy. Providing measurements from such devices to the microcontroller can allow the stuffed toy to more compellingly interact with the user. For example, a stuffed toy, e.g. a cat, can produce pre-recorded sounds, e.g. meowing, consistent with the user contact, e.g. stroking along the kitten's back.

Lullabies are a well-established technique for soothing children to sleep. Not all parents, however, are equally patient or musically inclined. Accordingly, toy manufacturers offer a wide variety of musical children's toys to aid parents in "singing their children to sleep". Traditionally, such toys incorporate a windup music box movement that produces music for a limited period of time; long enough, the parents hope, to sooth the child to sleep. More recently, toy manufacturers have incorporated electronic music units, e.g. embedded microcontrollers driving piezoelectric tone generators or MP3 players. Typically, such units provide music of limited duration or music of gradually decreasing tempo or volume.

The musical mechanism is often incorporated within a toy, e.g. a plush stuffed animal, which may provide additional emotional comfort to the child. Older children with greater mental capacity, however, may find such passive toy designs insufficiently engaging. Such toys offer little enticement to a stubborn toddler that is simply not ready for sleep. Parents are thus faced with a dilemma. They desire a toy that is sufficiently engaging to lure a child to bed, yet not so stimulating as to actually inhibit sleep.

It would thus be advantageous to provide a simple and cost-effective mechanism for producing music with a stuffed toy, wherein the music is sufficiently engaging for a child. Such a mechanism would provide a substantial technical advance.

Furthermore, it would be advantageous to provide a structure, system and process for measuring the intensity of a pressure that is applied across one or more portions of the perimeter of an object, such as but not limited to a stuffed toy. Such a development would provide an additional technical advance.

SUMMARY OF THE INVENTION

Enhanced devices, processes, and systems provide measurement of electrical capacitance as a means for determining the intensity with which stress is applied to an object, such as but not limited to a toy, e.g. a stuffed toy. One or more actions may preferably be taken in response to the determined stress or the change in electrical capacitance. An exemplary squeezable musical toy may preferably produce repeating, decaying musical notes in response to exterior pressure applied by a user. A microcontroller, such as a microcontroller embedded within the musical toy, may preferably be configured to determine the tone of each note, based on the exterior location at which the user applies pressure to the toy. The initial amplitude of each note may preferably be proportional to the intensity, as measured by a stress sensor. Thereafter, the toy may preferably repeat each note in a periodic manner, attenuating the amplitude of each successive repetition by a decay factor.

The enhanced toy may preferably purge a note, i.e. cease repetition of the note, when the amplitude of the note falls below a predetermined threshold. Alternatively, or in addition, the enhanced toy may preferably purge the oldest currently repeating note when a user initiates a new note, and the total number of currently repeating notes has reached a predetermined maximum number of notes. The enhanced toy may also alter the notes that are associated with different locations on the exterior of the enhanced toy. For example, if all currently repeating notes have decayed below a predetermined threshold, the currently available set of notes, e.g. across all exterior locations, may preferably be exchanged for a new set of notes, with different tones or timbres.

The enhanced toy may therefore be configured to produce a user-created, repeating sequence of notes, in which older notes decay towards silence, referred to as a looping and decaying score. Additional notes of varied tone and timbre may preferably be available for exploration, for example if the child is patient enough to await the decay of the currently repeating notes. The enhanced toy may therefore be configured to be initially engaging, but ultimately soothing, such as to calm an active child towards sleep.

DETAILED DESCRIPTION OF PREFERRED EMBODIMENTS

Figure 1:
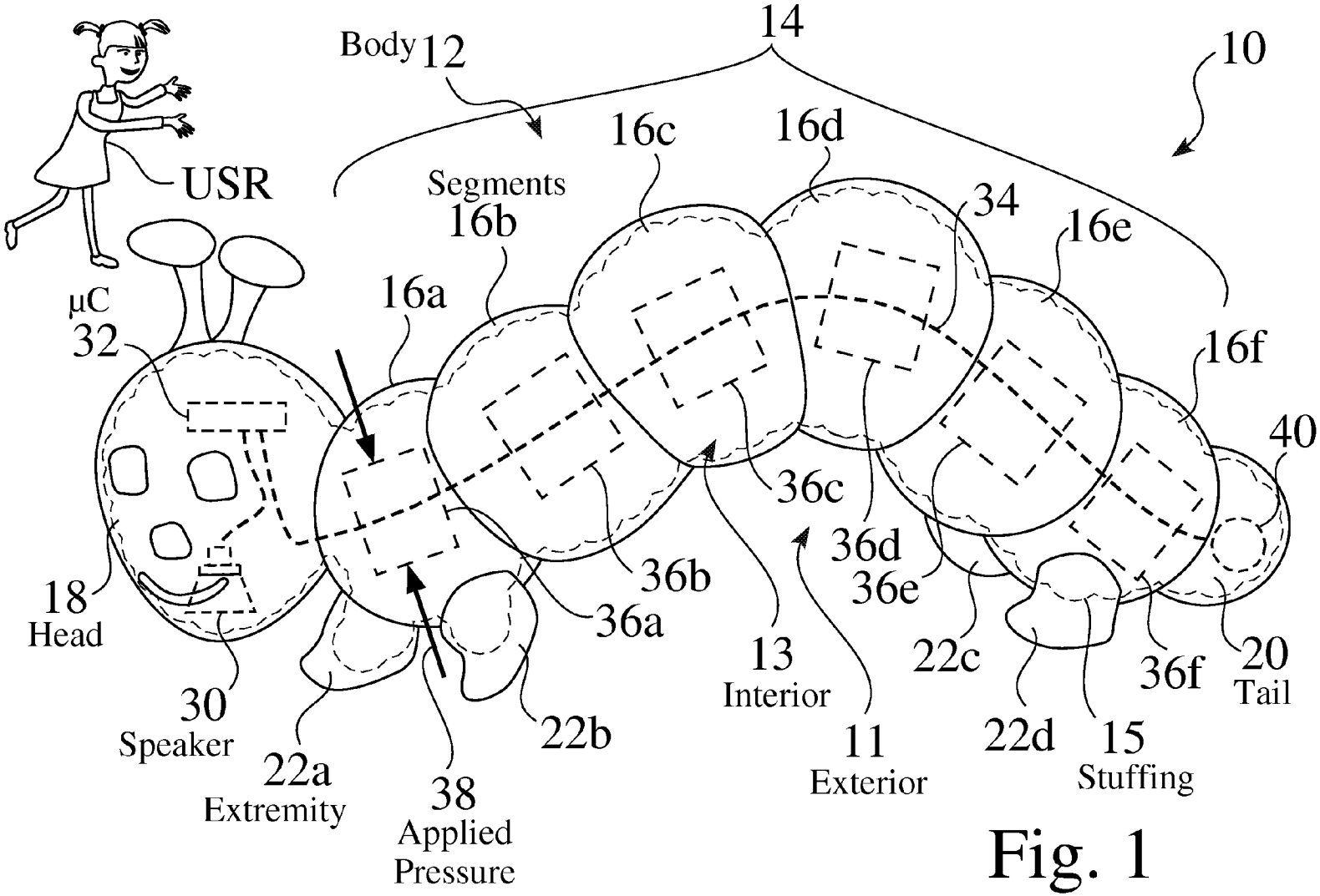
FIG. 1 is a schematic view of an exemplary squeezable musical toy having a plurality of stress sensors.

FIG. 1 is a schematic view of an exemplary squeezable musical toy 10 having a plurality of stress sensors 36, e.g. 36*a*-36*f*, and a looping and decaying musical score 100 (FIG. 4) associated therewith. The exemplary toy 10 seen in FIG. 1 comprises a body 12, e.g. plush stuffed animal body 12, such as but not limited to a segmented caterpillar 12. For example, the enhanced caterpillar 12 seen in FIG. 1 comprises a plurality of segments 16, e.g. 16*a*-16*f*, that extend between a head 18 and a tail 20. One or more extremities 22, e.g. 22*a*-22*d*, such as but not limited to legs, arms, feet, wings, flippers, and/or antennae 22, may also be included with the body 12. At least a portion of the interior 13 of the body 12 is typically filled with stuffing 15, e.g. such as but not limited to cotton, polyester, or foam rubber.

Figure 11:
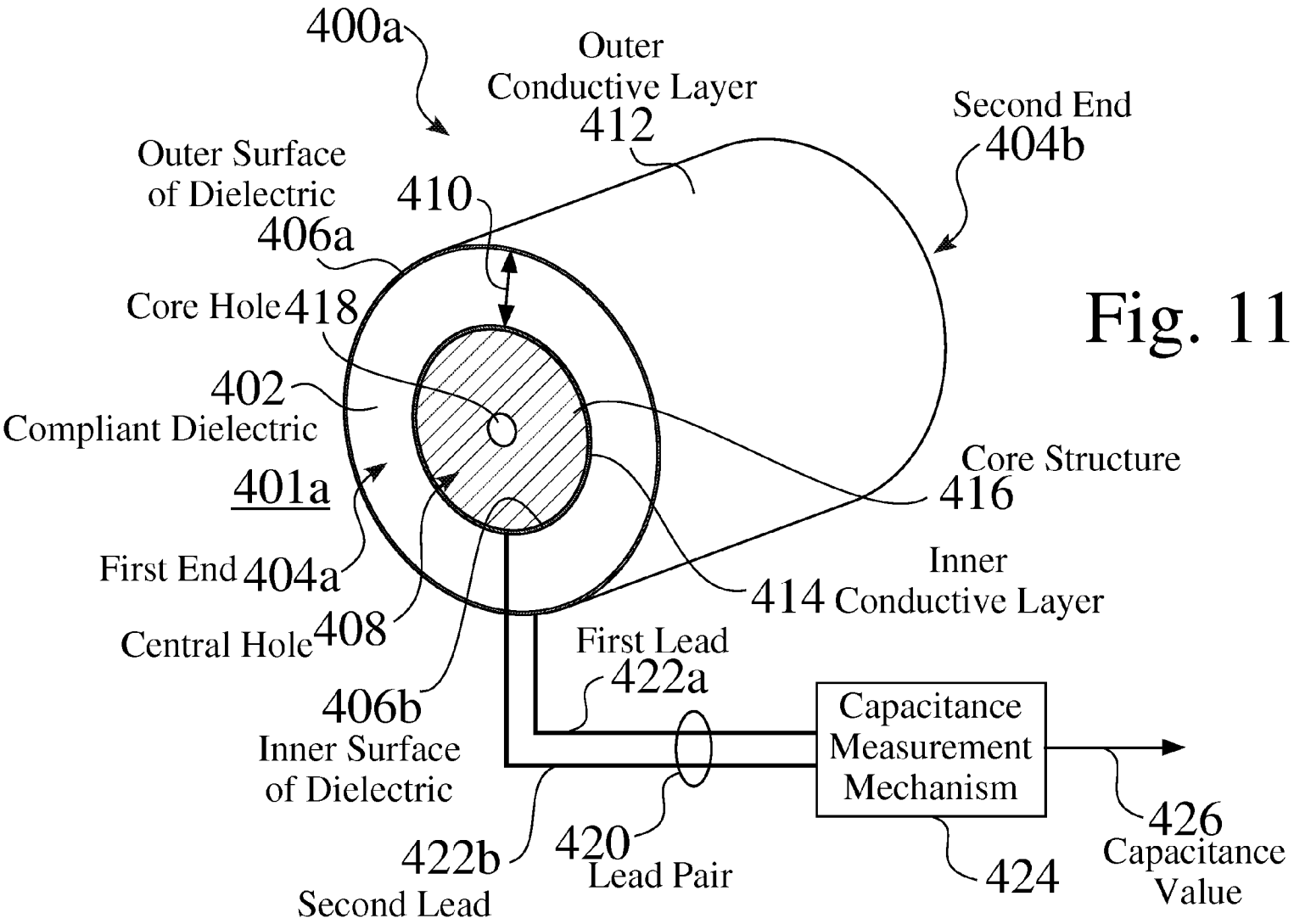
FIG. 11 is a schematic diagram of an exemplary stress sensor having variable capacitance, wherein the stress sensor is in a first undeformed position.

A stress sensor 36, e.g. 36*a*-36*f*, within each of the segments 16, and/or located within other portions of the body, e.g. the head 18, tail 20, and/or extremities 22, detects when a user USR applies a pressure 38 to the perimeter of the segment 16 or other corresponding portion, i.e. when the user USR applies a pressure, e.g. a radial pressure, by squeezing the segment 16. Additionally, the microcontroller 32 may preferably detect the intensity with which the user USR applies the pressure 38 to a sensor 36. For example, the microcontroller 32 may determine either or both of the magnitude and rate of change of the applied stress. A central structure 34 may extend through the body 12, such as for any of controllably locating the stress sensors 36, for providing a controlled form, e.g. a spine, for the toy, and/or to provide a conduit for lead pairs 420 (FIG. 11).

The enhanced toy 10 may preferably produce one or more sounds 82, e.g. musical notes 82 (FIG. 3) when a stress sensor 36 detects that the user USR has applied pressure to the segment 36, wherein the initial amplitude 104 (FIG. 4) of the note 82 may preferably be proportional to the measured intensity of the applied pressure 38. The notes 82 are broadcast through a speaker 30, which may preferably be located in the head 18 of the caterpillar 12. The tone of the note 82 is determined by the particular segment 16, e.g. 16*a*, to which the pressure was applied. For example, in the caterpillar 12 of FIG. 1, the first five segments 16*a*-16*e* may preferably correspond to tones in a scale, e.g. such as but not limited to a pentatonic, i.e. five note, scale. Similarly, for an enhanced toy 10 having seven or more segments 16, seven of the segments 16 may preferably correspond to a heptatonic, i.e. seven note, scale.

The exemplary squeezable musical toy 10 may preferably produce repeating, decaying musical notes 82 in response to exterior pressure 38 applied by a user USR. A microcontroller 32, such as a microcontroller 32 embedded within the musical toy 10, may preferably be configured to determine the tone of each note 82, based on the exterior location at which the user USR applies pressure 38 to the toy 10. The initial amplitude 104 (FIG. 4) of each note 82 is proportional to the intensity, as measured by a stress sensor 36, with which the pressure is applied. Thereafter, the toy 10 repeats each note 82 in a periodic manner, attenuating the amplitude 104 of each successive repetition by a decay factor Dc.

Figure 20:
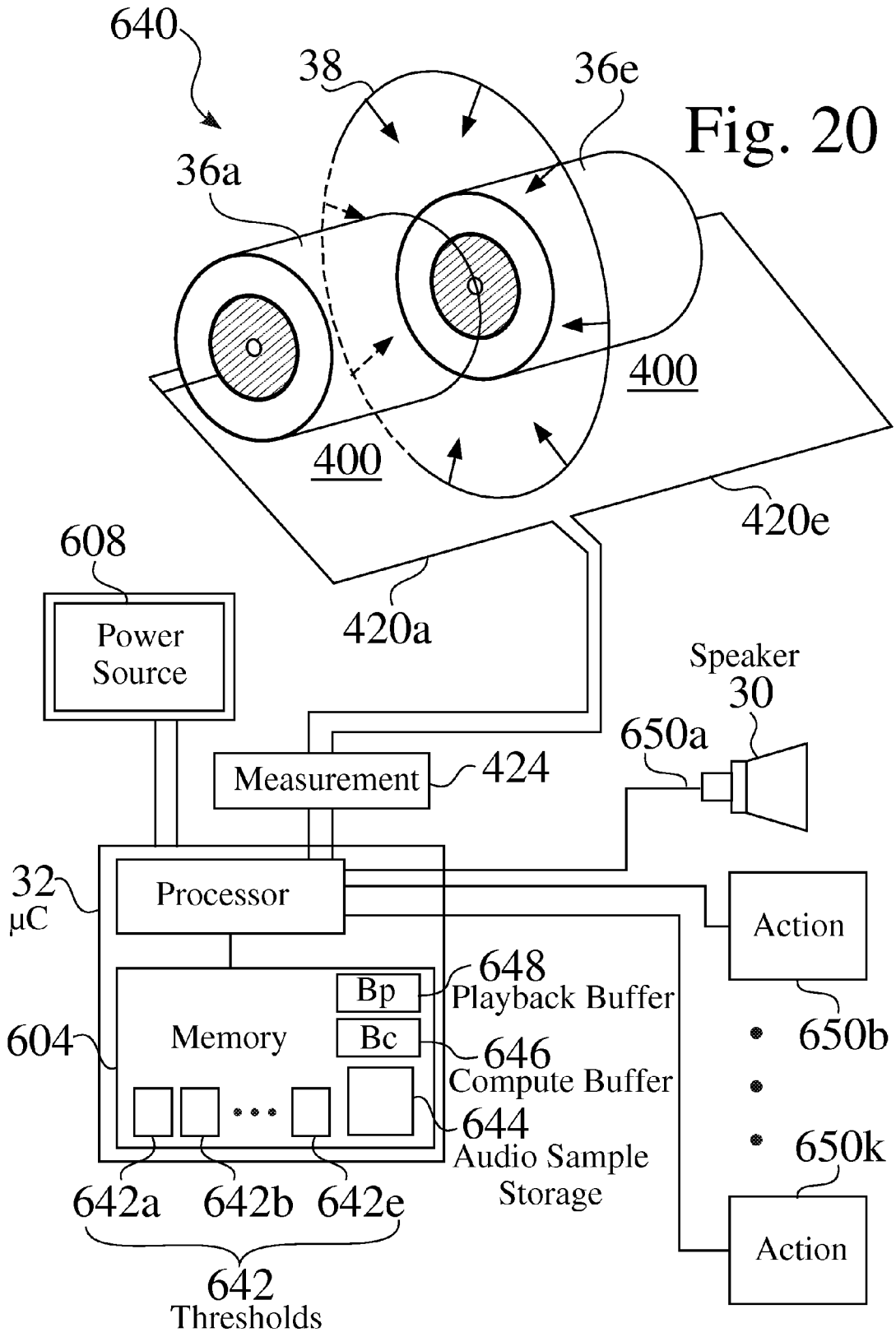
FIG. 20 is a schematic diagram of a system for measuring electrical capacitance as a function of pressure applied to enhanced capacitor structures, and for controllably taking one or more actions in response to the measured electrical capacitance.

The toy 10 may preferably purge a note 82, i.e. cease repetition of the note 82, when the amplitude 104 of the note 82 falls below a predetermined threshold 642, e.g. 642*b* (FIG. 20). Alternatively, or in addition, the toy 10 may preferably purge the oldest currently repeating note 82 when a user USR initiates a new note 82, and the total number of currently repeating notes 82 has reached a predetermined maximum number of notes 82. The toy 10 may also alter the note 82 associated with each location 16 on the exterior 11 of the toy 12. For example, if all currently repeating notes 82 have decayed below a predetermined threshold 642, e.g. 642*b* (FIG. 20), the currently available set of notes 82, e.g. across all exterior locations, may preferably be exchanged for a new set of notes 82 with different tones or timbres.

The enhanced toy 10 may therefore be configured to produce a user-created, repeating sequence of notes 82, in which older notes 82 decay towards silence (a "looping and decaying score"). Additional notes 82 of varied tone and timbre may preferably be available for exploration, such as if the child is patient enough to await the decay of the currently repeating notes. The enhanced toy 10 may therefore preferably be configured to be initially engaging, but ultimately soothing, which is well suited to calming an active child towards sleep.

In some embodiments, the stress sensors 36 may preferably comprise flexible capacitors 400 (FIG. 11) within the interior 13 of the enhanced toy 10. As the user applies pressure 38 to the exterior of the enhanced toy 10, the geometry of the capacitive sensor 400 deforms, altering the capacitance 426 (FIG. 11). The enhanced toy 10 determines the intensity of the applied pressure 38, by measuring the resulting change in capacitance 426. In particular, the enhanced toy 10 may consider a sensor 36,400 to be active, and produce a note, 82, when the intensity of the applied pressure 38 exceeds a predetermined threshold 642 (FIG. 20), e.g. 642*a*.

Figure 2:
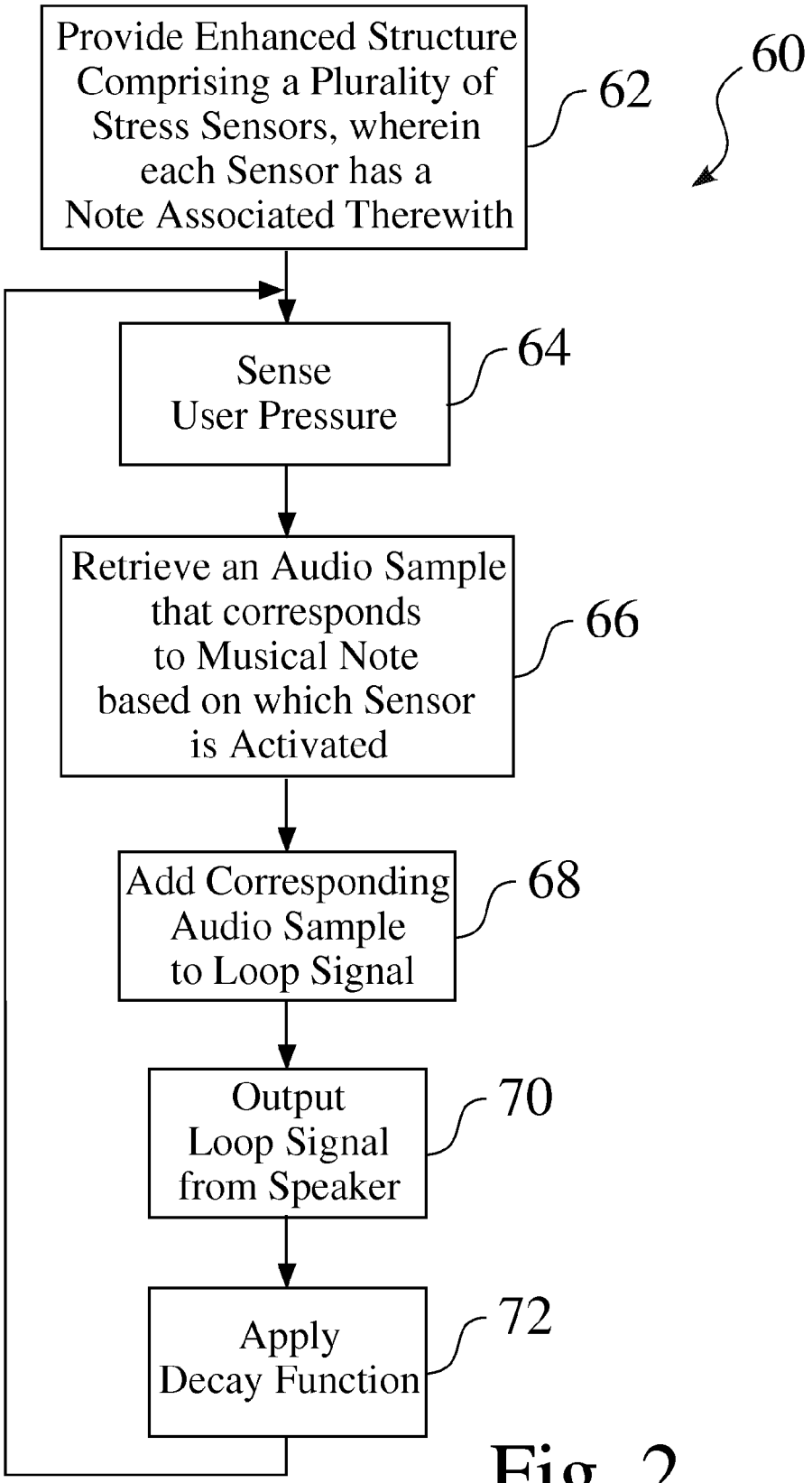
FIG. 2 is a flowchart of an exemplary process associated with a squeezable musical toy that is configured to produce a looping and decaying musical score as a function of user pressure.

FIG. 2 is a flowchart of a basic exemplary process 60 associated with an enhanced squeezable musical toy 10 that is configured to produce a looping and decaying musical score as a function of user pressure 38. The structure 10 is provided 62, wherein the structure 10 comprises a plurality of stress sensors 36, e.g. 36*a*-36*e*, wherein each sensor 36 has a tone associated therewith. The structure 10, such as through an embedded microcontroller 32, senses 64 user pressure 38 upon one or more of the sensors 36. The microcontroller 32 retrieves 66 an audio sample 92 (FIG. 3) that corresponds to a musical note 82, based on which sensor 36 was activated 64. The microcontroller 32 adds 68 the retrieved audio sample 92 to a music loop score 100 (FIG. 4), which is output 70 as a loop signal 620 from a speaker 30. A decay function Dc may also be applied 72, such as to slowly fade the volume of previously entered notes 82.

The squeezable toy 10 is configured to produce repeating, decaying musical notes 82 in response to exterior pressure 82 applied by a user USR. A microprocessor 32 determines the tone of each note 82, based on the exterior location 16 at which the user USR applies pressure 38 to the toy 10. The initial amplitude 104 (FIG. 4) of each note 82 is proportional to the intensity, as measured by a stress sensor 36, with which the pressure 38 is applied. Thereafter, the toy 10 repeats each note 82 in a periodic manner, attenuating the amplitude 104 of each successive repetition by a decay factor Dc.

Figure 12:
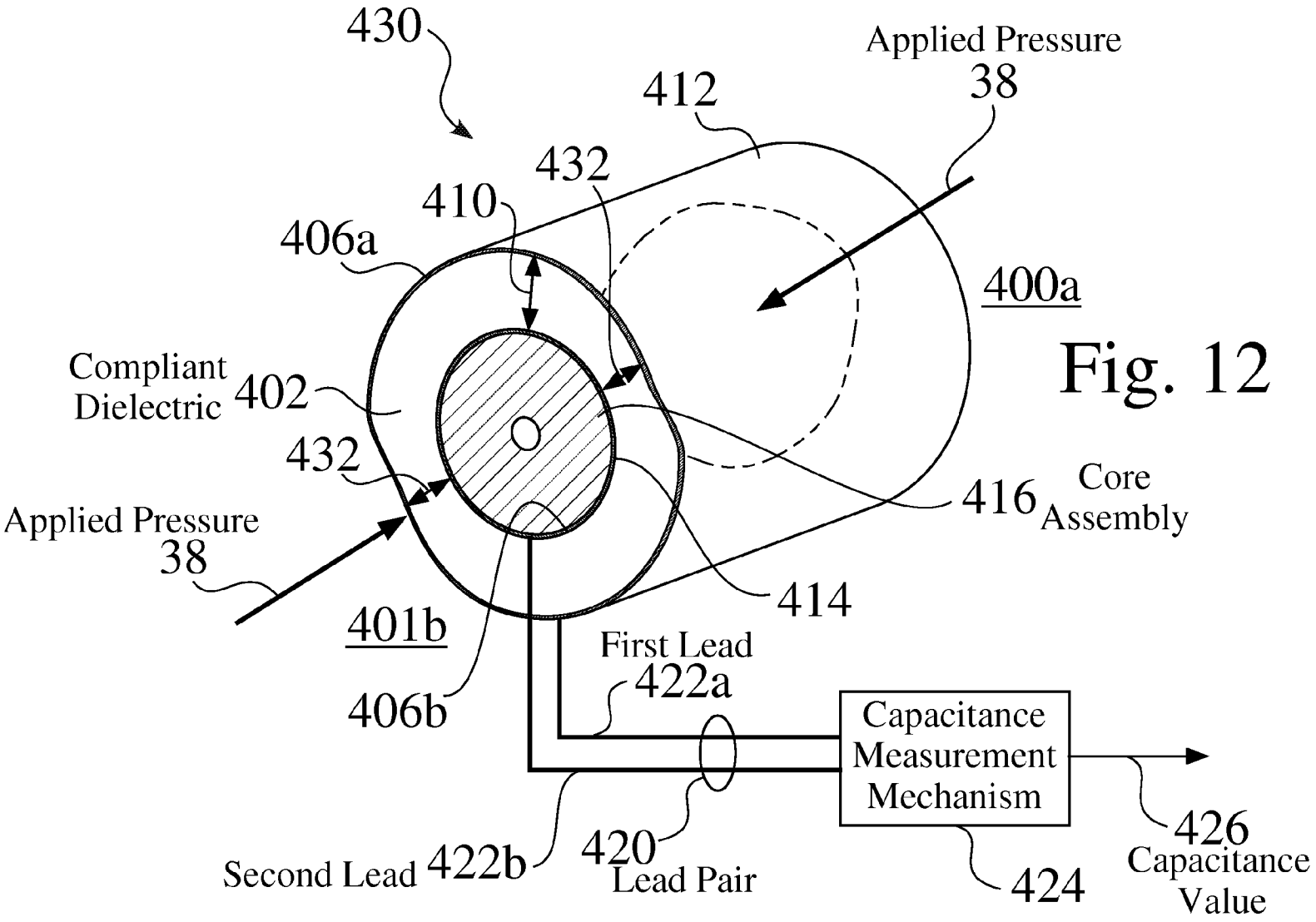
FIG. 12 is a schematic diagram of an exemplary stress sensor having variable capacitance, wherein the stress sensor is in a second deformed position.

The toy 10 may preferably be configured to alter the note 82 associated with each location 16 on the exterior of the toy 10. For example, if all currently repeating notes 82 have decayed below a predetermined threshold 642 (FIG. 20), e.g. 642*b*, the currently available set of notes 82, e.g. 82*a*-82*e*, across all exterior locations 16, may be exchanged for a new set of notes 82, e.g. 82*a*-82*e*, with different tones or timbres. In some embodiments of the enhanced musical toy 10, the stress sensors 36 may preferably comprise flexible capacitors 400 (FIG. 11, FIG. 12) that are located within the interior 13 of the enhanced toy 10. As the user USR applies pressure 38 to the exterior 11 of the toy 10, the geometry of one or more capacitors 400 deforms, altering the capacitance 426. The enhanced toy 10 determines the intensity of the applied pressure 38, by measuring the resulting change in capacitance 426 (FIG. 12).

Figure 3:
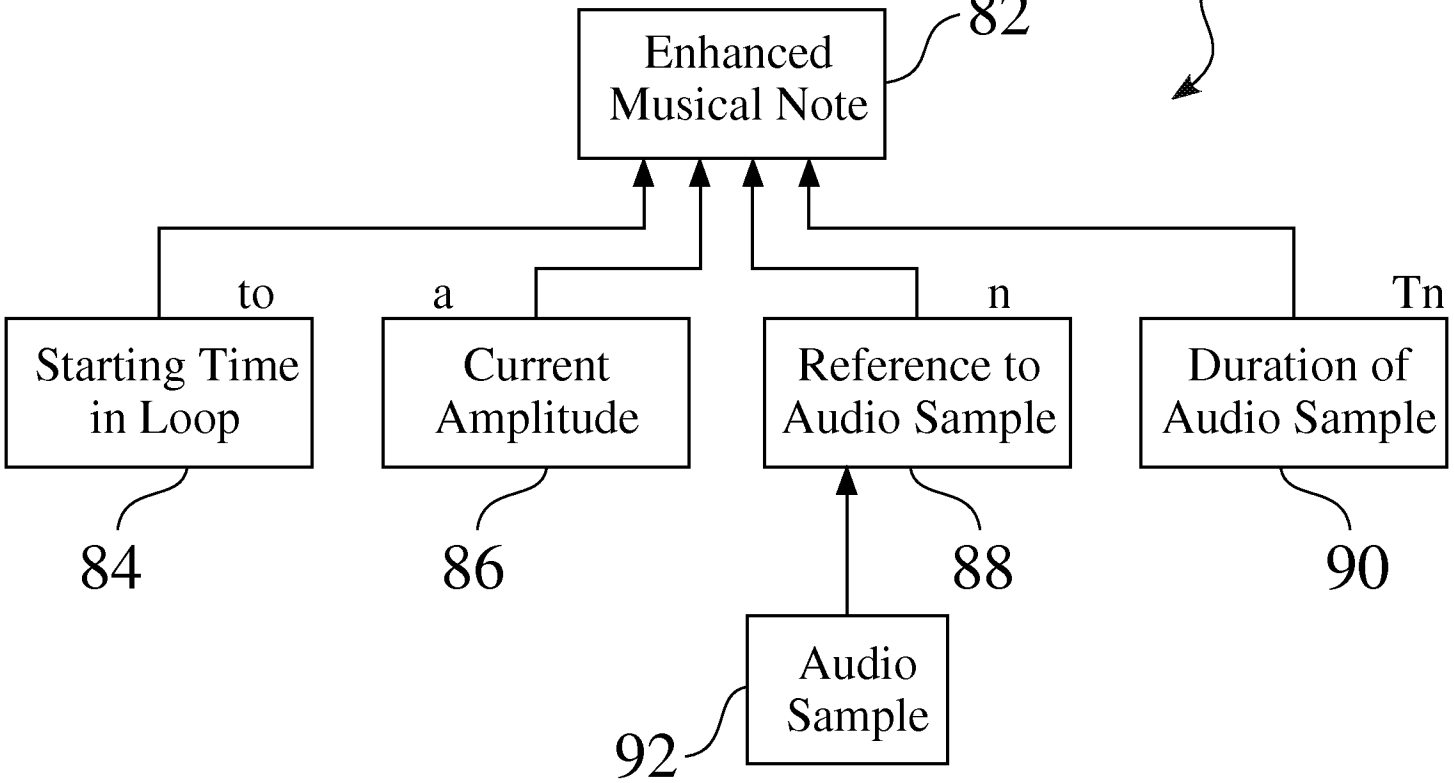
FIG. 3 is a schematic diagram that illustrates an enhanced musical note.

FIG. 3 is a schematic diagram 80 that illustrates an enhanced musical note 82. The microcontroller 32, such as a microcontroller within the enhanced musical toy 10, stores in memory 604 (FIG. 19) a list of currently repeating notes 82. Each note 82 is characterized by:

- a starting time 84 (within the looping score 100);
- current amplitude 86;
- a reference 88 to an audio sample 92 (FIG. 3), that when reproduced from memory 604 will yield the desired tone, e.g. within a pentatonic scale; and
- a duration 90 of the audio sample 92.

Figure 4:
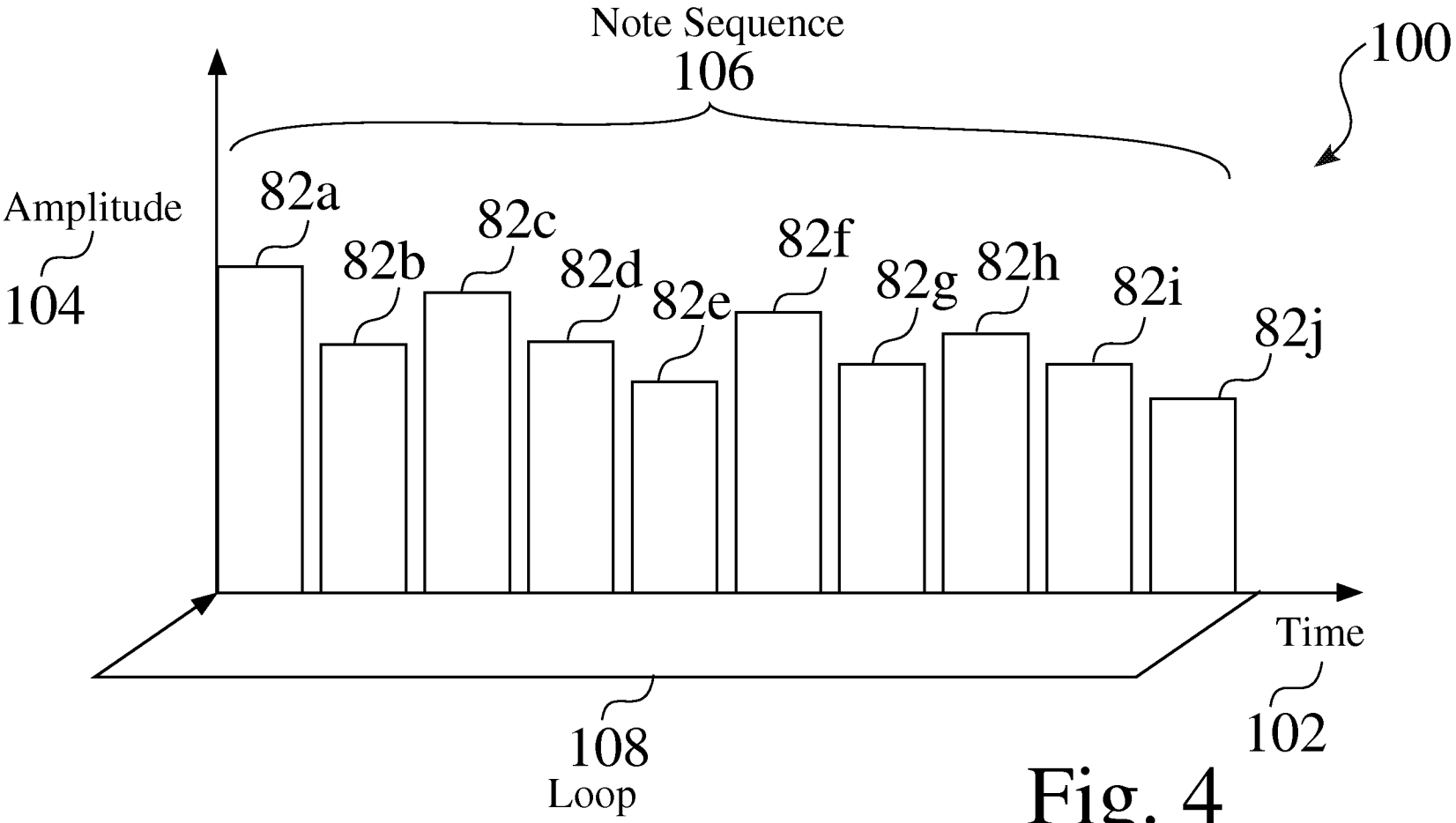
FIG. 4 is a chart that shows an exemplary looping and decaying musical score.

FIG. 4 is a chart that shows an exemplary looping and decaying musical score 100. A sequence 106 of notes 82, e.g. 82*a*-82j, is produced through user interaction 38 with the musical toy 10, wherein the notes are arranged in time 102, and have an associated amplitude 86. The musical score 106 may preferably be looped 108, and may decay the amplitude, i.e. the volume 86 of notes 82, as the loop 108 progresses.

Figure 5:
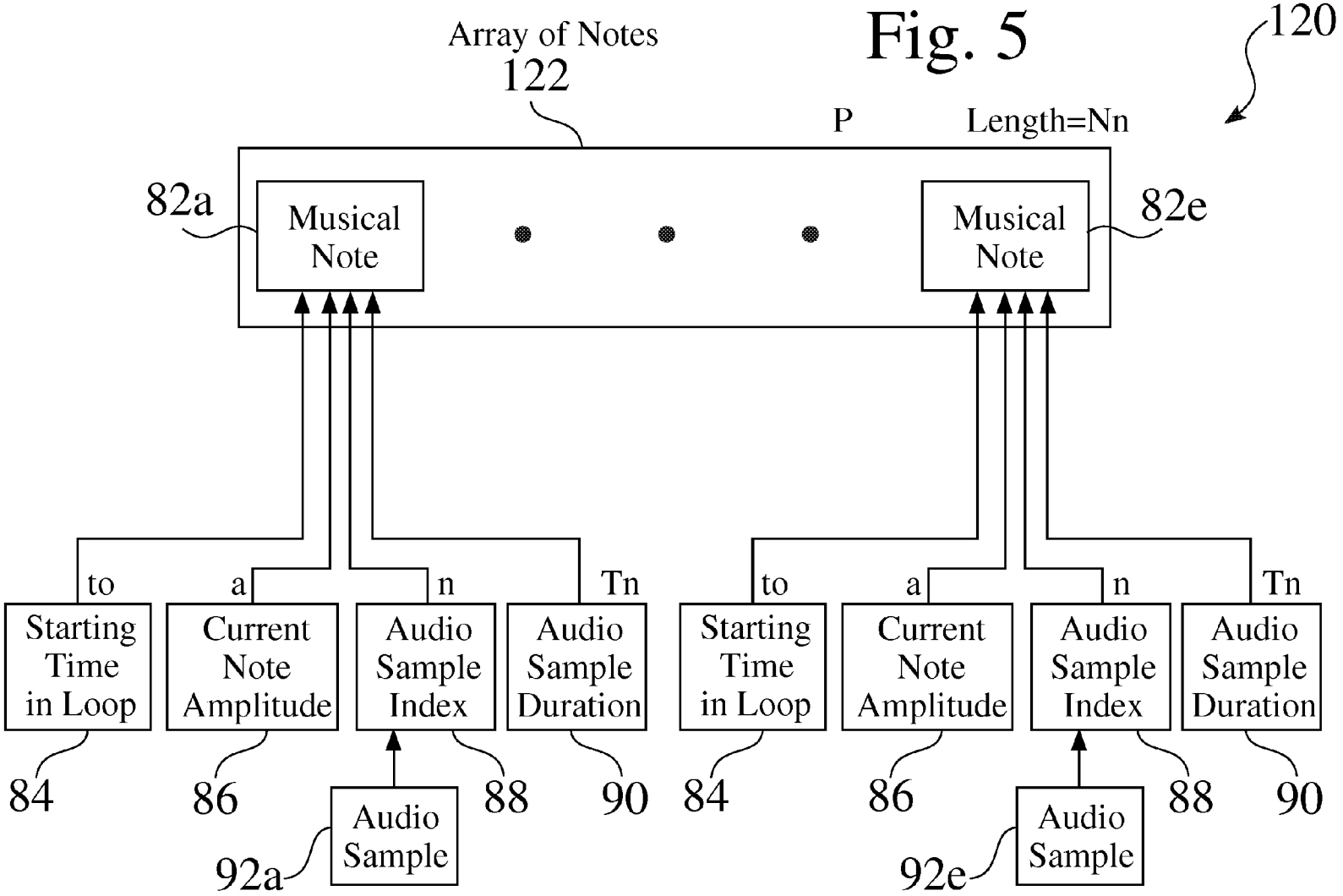
FIG. 5 is a schematic diagram showing an exemplary note array comprising a plurality of musical notes.

FIG. 5 is a schematic diagram 120 showing an exemplary note array 122 comprising a plurality of musical notes 82, wherein each of the notes is 82 is characterized by a starting time 84 within the looping score 100, a current amplitude 86, a reference 88 to an audio sample 92 (FIG. 3), and a duration 90 of the audio sample 92.

Implementation. The looping and decaying score 100 can be implemented through the microcontroller 32, such as a microcontroller 32 that is configured to operate based on pseudocode that is converted to an appropriate programming language.

The microcontroller 32 receives input from a plurality of stress sensors, e.g. 36*a*-36*e*, and references five different audio samples 92, e.g. 92*a*-92*e*, that correspond to a respective sensor 36, e.g. a first audio sample 92*a* is associated with a first stress sensor 36*a*. The audio samples 92 are typically stored in a portion 644 of non-volatile memory 604 (FIG. 20), and each of the audio samples 92 have a respective duration 90 (Tn). For the current example described herein, the audio output clock, and the sample rate of the audio files 92, is given as Fa.

Figure 6:
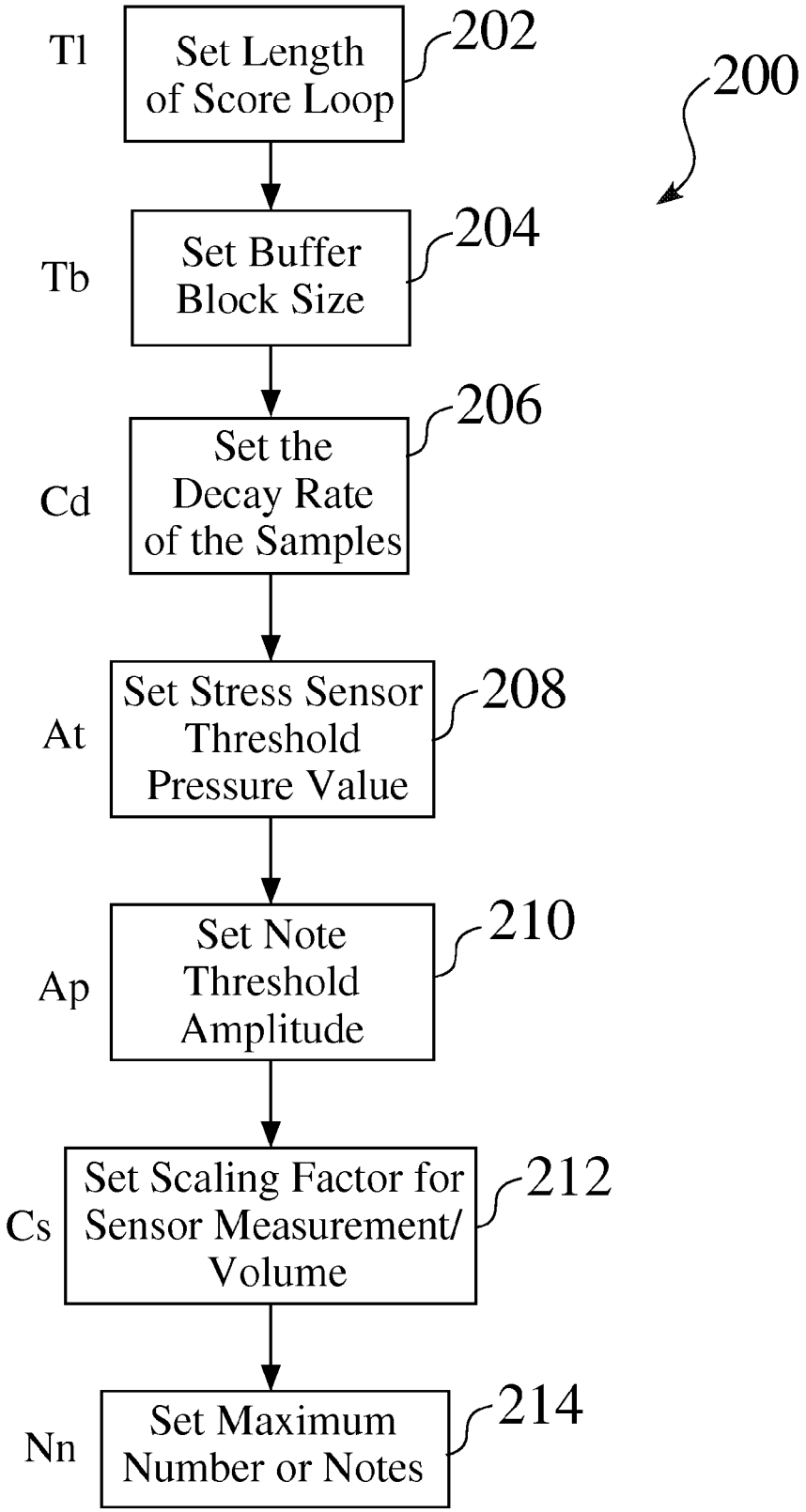
FIG. 6 shows exemplary process steps associated with the setting of process parameters for a looping and decaying musical score produced through user interaction with a plurality of stress sensors.

FIG. 6 shows exemplary process steps 200 associated with the setting of process parameters for a looping and decaying musical score 100 produced through user interaction 38 with a plurality of stress sensors 38.

For example, as seen in FIG. 6, the length in time of the score loop may be set 202, e.g. by setting a loop time Tl to 10 seconds. The size of a buffer block Tb may be set 204, e.g. Tb=0.010. The decay rate Cd of the samples 92 may be set 206, e.g. by setting Cd=0.35. The threshold pressure value 642, e.g. 642*a* (FIG. 20), above which a stress sensor 36 is be considered active may be set 208, e.g. by setting At to a desired value, which may preferably be determined empirically. The threshold amplitude 642, e.g. 642*b* (FIG. 20), for a note 82, below which a note 82 will not be rendered, may be set 210, e.g. by setting Ap to a desired value, which may preferably be determined empirically. A scaling factor Cs may be set 212, to relate sensor measurements to audio volume 212, e.g. by setting Cs to a desired value, which may preferably be determined empirically. The maximum number Nn of notes 82 to be to remembered may also be set 214, e.g. by setting Nn=10.

The exemplary process steps 200 seen in FIG. 6 may be provided in pseudocode, as shown:

```
# The length of the score loop in seconds.
Tl = 10
# The buffer block size.
Tb = 0.010
# The decay rate of the samples.
Cd = 0.35
# The threshold value above which a stress sensor is considered active.
At = <determined empirically>
# The threshold amplitude below which a note will not be rendered.
Ap = <determined empirically>
# Scaling factor relating sensor measurements to audio volume.
Cs = <determined empirically>
# The maximum number of notes remembered.
Nn = 10
```

Figure 7:
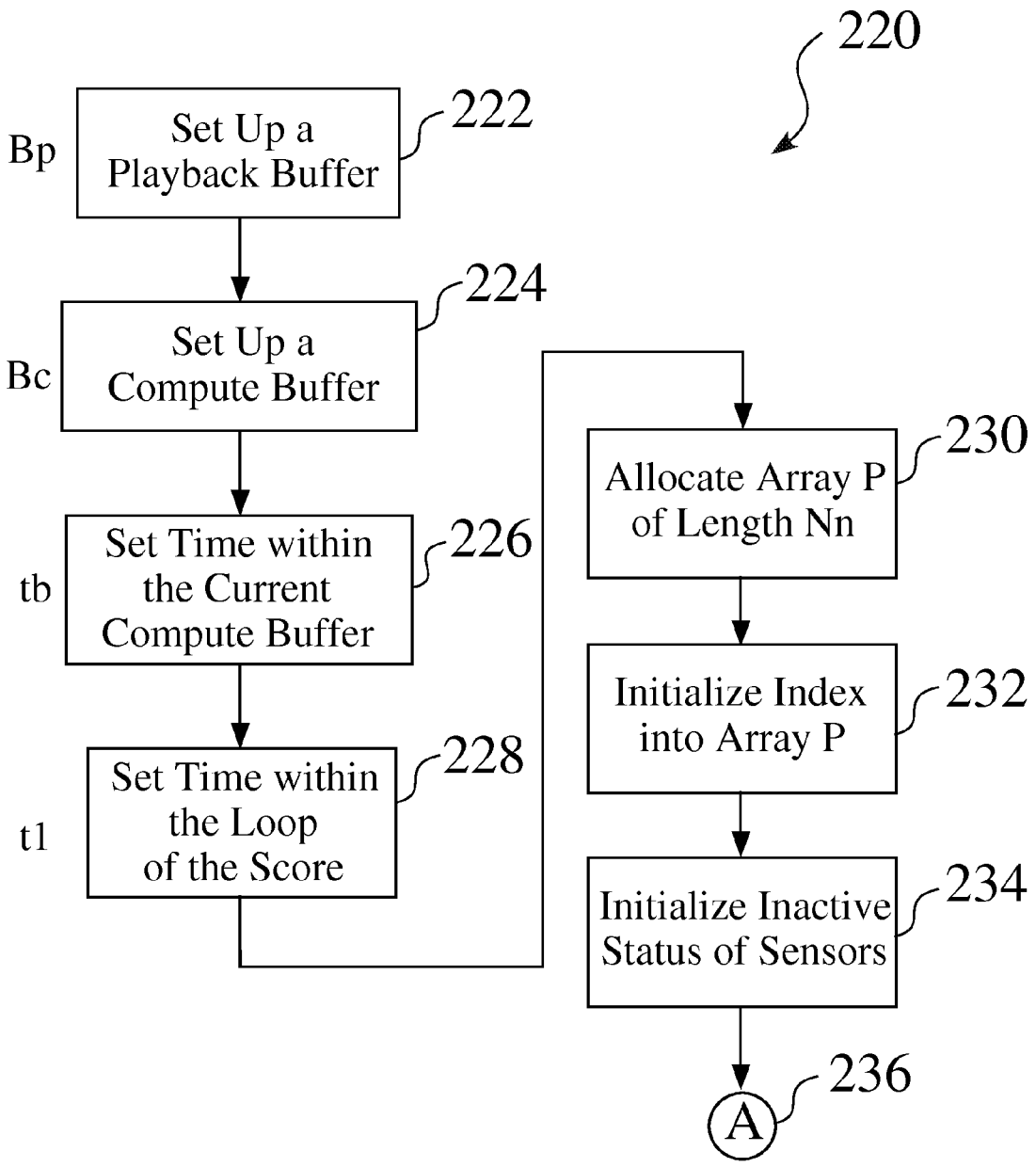
FIG. 7 shows exemplary process steps associated with the initialization of playback and compute buffers for a looping and decaying musical score produced through user interaction with a plurality of stress sensors.

FIG. 7 shows exemplary process steps 220 associated with the initialization of a playback buffer 648 (FIG. 20) and a compute buffer 646 (FIG. 20) for a looping and decaying musical score 100 produced through user interaction 38 with a plurality of stress sensors 36.

For example, as seen in FIG. 7, a playback buffer 648 may be set up 222, e.g. by allocating an appropriate length for the playback buffer 648. A compute buffer 646 is also set up 224, e.g. by allocating an appropriate length for the compute buffer 646. The time tb within the current compute buffer 646 may be set 226, e.g. such as by setting an initial time tb=0. The time tl within the loop 100 of the score 122 may be set 228, e.g. such as by setting an initial loop time tl=0. The microcontroller 32 may be configured to allocate 230 an array P of length Nn; initialize 232 an index into the array P, e.g. set p=0; and initialize 234 the status of the sensors 36, e.g. by initially declaring that none of five stress sensors 36*a*-36*e* are currently activated, e.g. Sa [1 . . . 5]=False, before proceeding 236, as also shown in FIG. 8.

The exemplary process steps 220 seen in FIG. 7 may be provided in pseudocode, as shown:

```
# Setup a playback buffer.
allocate buffer Bp of length Tb (Nb = Tb*Fa)
# Setup a compute buffer.
allocate buffer Bc of length Tb (Nb = Tb*Fa)
# The time within the current compute buffer.
tb = 0
# The time within the loop of the score.
tl = 0
# An array of notes.
# Each note is a tuple (to,a,n,Tn).
# to is the note starting time (within the score loop)
# a is the current note amplitude
# n is the audio sample index
# Tn is the duration of the audio sample
allocate array P of length Nn
# Initialize index into P.
p = 0
# Initially, declare that none of the five stress sensors are being actuated.
Sa[1...5] = False
```

Figure 8:
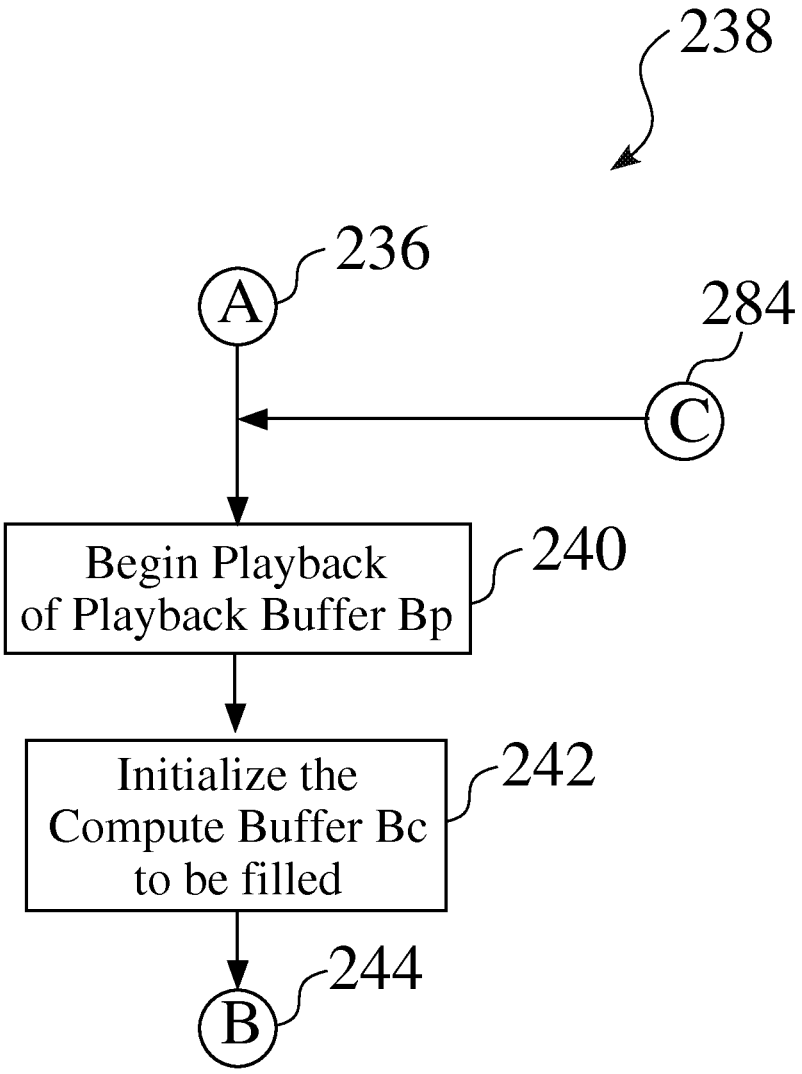
FIG. 8 shows a first portion of exemplary process steps associated with a squeezable musical toy that is configured to produce a looping and decaying musical score.

FIG. 8 shows a first portion of exemplary process steps 238 associated with a squeezable musical toy 10 that is configured to produce a looping and decaying musical score 100. For example, the microcontroller 32 may be configured to begin playback 240 of the playback buffer 648, and initialize 242 the compute buffer 646 to be filled, before proceeding 244, as also seen in FIG. 9.

Figure 9:
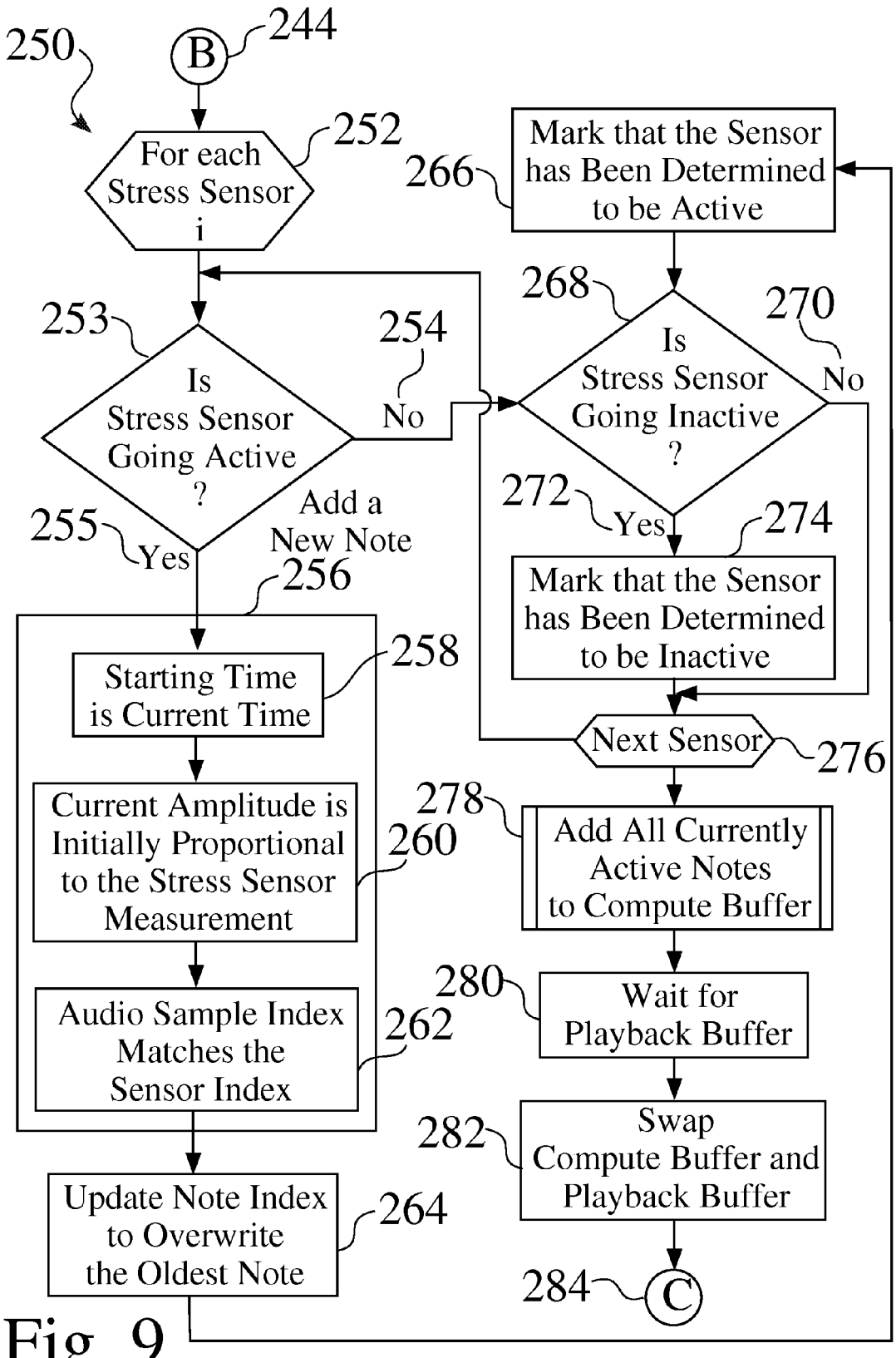
FIG. 9 shows a second portion of exemplary process steps associated with user activations of one or more of a plurality of stress sensors.

FIG. 9 shows a second portion of process steps 250 associated with user activations of one or more of a plurality of stress sensors 38, such as after 244 beginning playback 238 (FIG. 8) of the playback buffer 648.

For example, as seen in FIG. 9, the microcontroller 32 may be configured to perform 252, for each stress sensor 36, e.g. 36*a*-36*e*, a determination 254 if this is the first time since the given sensor was last determined to be inactive, that the given sensor 36 is going active, e.g. as a user USR begins pressing a given sensor 36. If so 255, the microcontroller adds 256 a new note 82 to the array of notes 122 (FIG. 5), wherein the starting time is set 258 as the current time, wherein the current amplitude 86 is set 260 to be initially proportional to the stress sensor measurement, and wherein the audio sample index is matched 262 to the sensor index. The note index is updated 264 to ensure that the oldest note 82 is overwritten next, and the microcontroller 32 marks 266 that the sensor 36 has been determined to be active.

The microcontroller 32 is also configured to determine 268, either from step 266, or from a negative result 254 from decision 253, if the stress sensor 36 is going inactive. If the determination 268 is positive 272 that the given stress sensor is going inactive, the microcontroller 32 is configured to mark 274 that the sensor 36 has been determined to be inactive, and the process returns 276 as necessary, i.e. for processing in regard to other sensors. If the determination 268 is negative 270, the process also returns 276, i.e. bypassing the marking step 276.

Figure 10:
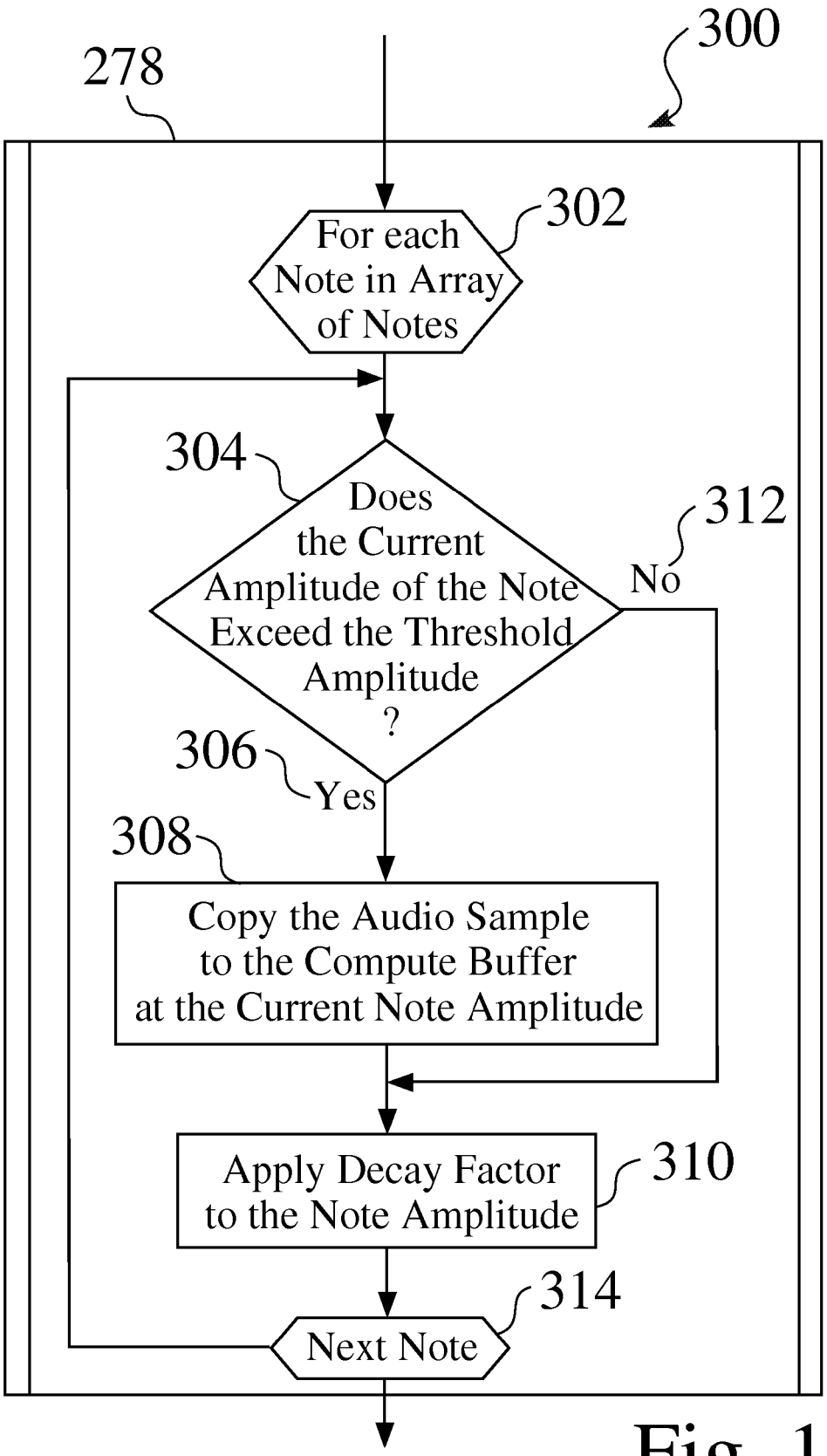
FIG. 10 shows exemplary process steps associated with the adding of currently active notes to a compute buffer, and the application of a decay factor to the notes.

Once the processing of all sensors 36 is complete, the microcontroller 32 is configured to add 278 all of the currently active notes 82 to the compute buffer 646, such as shown in detail in FIG. 10. The microcontroller 32 is also configured to wait 280 for the playback buffer 648 to finish playing, at which time the compute buffer 646 and the playback buffer 648 are swapped 282, when the process returns 284 to begin playback 238 (FIG. 8) of the updated playback buffer 648.

FIG. 10 shows detailed exemplary process steps 300 that may preferably be associated with the adding 278 of currently active notes 82 to a compute buffer 646, and the application of a decay factor to the notes 82. For example, as seen in FIG. 10, the microcontroller 32 may be configured to perform 302, for each note 82 in an array 122 of notes 82, e.g. 82*a*-82*e* (FIG. 5), a determination 304 if the current amplitude 86 of the note 82 exceeds the threshold amplitude 642, e.g. 642*a*. If so 306, the microcontroller 32 copies 308 the corresponding audio sample 92 to the compute buffer 646 at the current note amplitude 86, applies 310 the decay factor to the current amplitude 86 of the note 82, and the process returns 314 as necessary, i.e. for processing in regard to other notes 82 in the array 122. If the determination 304 is negative 312, the process may also apply 310 the decay factor to the current amplitude 86 of the note 82 before returning 314, i.e. bypassing the copying step 308.

The exemplary process steps 238, 250, 300 seen in FIG. 8 through FIG. 10 may be provided in pseudocode, as shown:

```
forever:
    begin playback of Bp
    # Detect and instantiate new notes.
    # Initialize the compute buffer that will be filled.
    Bc[1...Nb] = 0
    for each sensor i in [1...5]:
        # If this is the first time the stress sensor is above the threshold value...
        if NOT Sa[i] AND S[i]>At:
            # Add a new note.
            # Starting time is current time.
            # Current amplitude is initially proportional to the stress sensor measurement.
            # Audio sample index matches the sensor index.
            P[p] = (tl, Ks*S[i], i)
            # Update note index to overwrite the oldest note.
            p++
            p = p modulo Nn
            # Mark that the sensor has been determined to be active.
            Sa[i] = True
        # If the stress sensor is going inactive...
        if Sa[i] AND S[i]<At:
            Sa[i] = False
    # Add all currently active notes to the compute buffer.
    # The compute buffer will be played out Tb later.
    for each note (to,a,n,Tn) in P:
        # If the compute buffer start is after sample end...
        if ((tl−to) modulo Tl) > Tn:
```

-continued

```
        # There is no overlap, on to the next note.
        continue
    # If buffer end is before sample start...
    else if ((to−tl) modulo Tl) > Tb:
        # There is no overlap, on to the next note.
        continue
    # The compute buffer overlaps with sample, so find out where.
    else:
        # If note wraps around the end of the score loop...
        if (to > ((to + Tn) modulo Tl)):
            # If the compute buffer start is before the end of the score loop...
            if (tl < ((to+tn) modulo Tl)):
                # Fill beginning at the compute buffer start.
                bstart = 0
                # From the difference between the compute buffer start
                # and the note starting time.
                nstart = (tl−to) modulo Tl
                # For the time between the compute buffer start and the note end,
                # or the compute buffer duration, whichever is shortest.
                length = min(Tb, ((to+Tn) modulo Tl) − tl)
            # Otherwise, the compute buffer start is after the end of the score loop...
            else:
                # Fill beginning at the compute buffer start,
                # or the distance from the note start to the compute buffer start,
                # whichever is bigger.
                bstart = max(0, to−tl)
                # From the difference between the compute buffer start and
                # the note start time, or the audio sample start, whichever is bigger.
                nstart = max(tl−to, 0)
                # For the time between the compute buffer end and the note end,
                # or the whole buffer, whichever is shortest.
                length = min(Tb, (tl+Tb)−to)
            # Otherwise, the note did not wrap around the end of the score loop...
            else:
                # Fill beginning at the compute buffer start, or the distance from the
                # audio sample start to the compute buffer start, whichever is bigger.
                bstart = max(tl−to, 0)
                # From the difference between the note start time and the compute
                # buffer start, or the audio sample start, whichever is bigger.
                nstart = max(to−tl, 0)
                # For the time between the compute buffer start and note end,
                # or the time between the compute buffer end and the sample end,
                # or the whole buffer, whichever is shortest.
                length = min(Tb, (to+Tn)−tl, (tl+Tb)−to)
            # If the current amplitude exceeds the threshold amplitude...
            if a > Ap:
                # Copy the audio sample's overlap region to the compute buffer,
                # scaled by the current note amplitude.
                Bc[bstart:bstart+length] += a * N[n][nstart:nstart+length]
            # If the end of the note was in the compute buffer...
            if tl < ((to+Tn) modulo Tl) <= tl+Tb:
                # Decay by Cd.
                a = a*(1−Cd)
        # Finished determining the compute buffer, so advance time Tb.
        tl = (tl+Tb) modulo Tl
        # Compute is faster than playback, so wait for the playback to catch up.
        wait for Bp to finish playing
        # Exchange compute and playback buffers to play what was just computed.
        swap Bp and Bc
```

Additional Audio Samples. Some embodiments of the enhanced musical toy 10 may preferably alter the note 82 associated with each location 16 on the exterior of the toy 10. For example, if the current amplitude 86 of all notes 82 within the list of currently repeating notes 82 falls below a predetermined threshold, the current set of audio samples 92 corresponding to each of the segments 16, e.g. 16*a*-16*e*, of the enhanced toy 10 can be exchanged for a new set of audio samples 92. Changing to a set of audio samples 92 with new tones can, for example, shift a scale, e.g. a pentatonic scale, up or down an octave. Alternatively, changing to a set of audio samples 92 with new timbres can provide a new "instrument".

Non-Musical Audio Samples. Many embodiments of the enhanced musical toy 10 are based on notes that correspond to the tones in a scale, e.g. a pentatonic scale. However, because a note is rendered from a digital audio sample 92 stored in memory 604 (FIG. 19, FIG. 20) within the toy 10, the structures are easily adapted to other musical applications using any number of audio samples corresponding to different notes arranged within different scales. As well, the structures, systems and processes may alternately be adapted for non-musical applications, e.g. such as but not limited to audio samples 92 that correspond to words, animal sounds, or other sounds.

Periodic Actuation. The concept of "notes" in a "looping score" can be further extended to additional forms of actuation 650 (FIG. 20) that may also preferably be periodically repeated in a decaying manner. For example, upon measuring an applied pressure 38 with a particular stress sensor 36, the enhanced toy 10 may preferably actuate a vibration mechanism 650, e.g. 650*b*, such as a motor with an eccentrically mounted weight on the output shaft, for a limited duration, at an initial intensity proportional to the intensity with which the pressure 38 is applied. The enhanced toy 10 may then repeat the vibration in a periodic manner, reducing the intensity of vibration with each repetition. Other stress sensors 36 may be associated with other actions 650, e.g. 650*k* (FIG. 20), such as but not limited to any of lights, heating elements, and other actuators that can be actuated for a limited period of time at a specified intensity.

Exemplary Stress Sensor Designs. FIG. 11 is a schematic diagram of an exemplary stress sensor 36 comprising a capacitor 400 having variable capacitance 426, wherein the stress sensor 36 is in a first undeformed state 401*a*. FIG. 12 is a schematic diagram 430 of the exemplary capacitive stress sensor of FIG. 11, wherein the stress sensor 36 is in a second deformed position 401*b*.

While some embodiments of the stress sensor 36 may preferably be implemented in conjunction with a musical toy 10, one or more stress sensors 36 may alternately be used for a wide variety of applications, such as but not limited to applications that require one or more discernable levels of deformation or capacitance 426.

The exemplary stress sensor 36 seen in FIG. 11 comprises a capacitor 400 that may readily be positioned within the interior 13 of the toy 10, wherein the geometry of the capacitor 400 deforms under pressure 38 applied to the exterior of the toy 10. The microcontroller 32, such as a microcontroller 32 that is located within the interior 13 of the toy 10, is configured to determine the intensity of the applied pressure 38, by measuring the resulting change in capacitance 426.

As seen in FIG. 11, a compliant generally cylindrical dielectric layer 402 extends from a first end 404*a* to a second end 404*b* opposite the first end 404*a*. The dielectric layer 402 comprises an outer cylindrical surface 406*a* that extends between the first end 404*a* and the second end 404*b*, and a central hole 408 defined between the first end 404*a* and the second end 404*b*, the central hole 408 being generally coaxial or concentric to the outer cylindrical surface 406*a*, and defining an inner cylindrical surface 406*b*, wherein a radial distance 410 is defined between the inner surface 406*b* and the outer surface 406*a*.

As also seen in FIG. 11, a first electrically conductive layer 412 is located on the outer cylindrical surface 406*a* of the compliant dielectric layer 402, and a second electrically conductive layer 414 is located on the inner compliant surface 406*b* of the cylindrical dielectric layer 402.

A lead pair 420 extends from the electrically conductive layers 412, 414 to a mechanism 424 for measurement of capacitance 426, wherein the mechanism 424 may typically be associated with the microcontroller 32. The lead pair 420 comprises a first electrically conductive lead 422*a* that extends from the outer conductive layer 412, and a second electrically conductive lead 422*b* that extends from the inner conductive layer 414.

The compliant dielectric layer 402 is compressible, i.e. deformable, in response to an applied radial pressure 38, such as across at least a portion of the compliant dielectric layer 402, wherein the capacitance 426 of the capacitive sensor 400 changes as a function of the applied radial pressure 38.

For example, as seen in FIG. 12, pressure 38 applied at one or more points about the perimeter of a portion of an enhanced toy 10 may result in deformation of at least a portion of the compliant layer 402 and the outer conductive layer 412, wherein a portion of the dielectric layer 402 may be compressed 432 inward from an initial thickness 410, thus resulting in a change in the capacitance value 426, such as measured through the capacitance measurement mechanism 424.

In some capacitive sensor embodiments 400, one or both of the electrically conductive layers or plates 412,414 may preferably be formed from metallized biaxially-oriented polyethylene terephthalate (metallized-boPET) film, such as but not limited to aluminized Mylar™, available through E. I. du Pont de Nemours and Company, of Wilmington, Del.; or an adhesive backed aluminum tape.

The outer layer or plate 412 forms the cylindrical exterior of the capacitive sensor 400. The inner plate 414 is concentric to the outer plate and surrounds a structural core 416, for example the closed-cell foam structural core 416 of FIG. 11. The dielectric layer 402 may alternately be comprised of a wide variety of materials, such as but not limited to any of open cell foam, closed cell foam, silicone rubber, or fabric. For example, in some embodiments of the capacitive sensor 400, a low-density, open-cell foam, e.g. such as but not limited to reticulated open cell 10-30 ppi Scott™ foam, such as available through Foam Mart, Inc. of Burbank, Calif., serves as the dielectric layer 402 between the two conductive layers or plates 412,414.

In some embodiments, the compliant nature of the plates 412,414, the dielectric layer 402, and structural core 416 yield a capacitive sensor 400 that is easily deformed when placed within the interior 13 of a stuffed toy body 12 having a flexible exterior 11. The areas of the plates 412,414, and the dielectric constant of the dielectric layer 402, preferably remain approximately constant during deformation, such that the capacitance 426 is largely a function of the changing separation between the plates 412,414.

To measure the changing capacitance 426, the microcontroller 32 periodically discharges and charges the capacitor 400, via a pair 420 of wires 422*a*,422*b*. By measuring the time required to attain a specified voltage across the plates 412, 414, the microcontroller 32 determines the current capacitance 426, and therefore the extent of the deformation, and the corresponding intensity of the applied pressure 38.

More specifically, the microcontroller 32 periodically discharges the capacitor 400 at a frequency, e.g. 15 kHz, that is greater than the computation buffer frequency (1/Tb) in the pseudocode through which the controller 32 may be configured to implement the looping and decaying score 100.

The microcontroller 32 alternately discharges the capacitive sensor 400 to ground 612 (FIG. 19), and charges the capacitive sensor 400, from a constant voltage source 608 (FIG. 19), e.g. 3.3 Volts, via a current limiting resistor 610 (FIG. 19), e.g. 200 k-Ohm. During the charging process, the microcontroller 32 measures the voltage across the capacitor plates 412,414, to determine the time required to reach a specific voltage, e.g. 2.0 Volts. The capacitance 426 is linearly proportional to the required charge time. The resulting measurement is filtered, to yield the stress sensor measurements (S[i]) in the pseudo-code implementing the looping and decaying score 100.

While the exemplary capacitive stress sensor 400 seen in FIG. 11 and FIG. 12 comprises a generally cylindrical structure, other embodiments of sensors having variable capacitance 426 are readily implemented.

Figure 13:
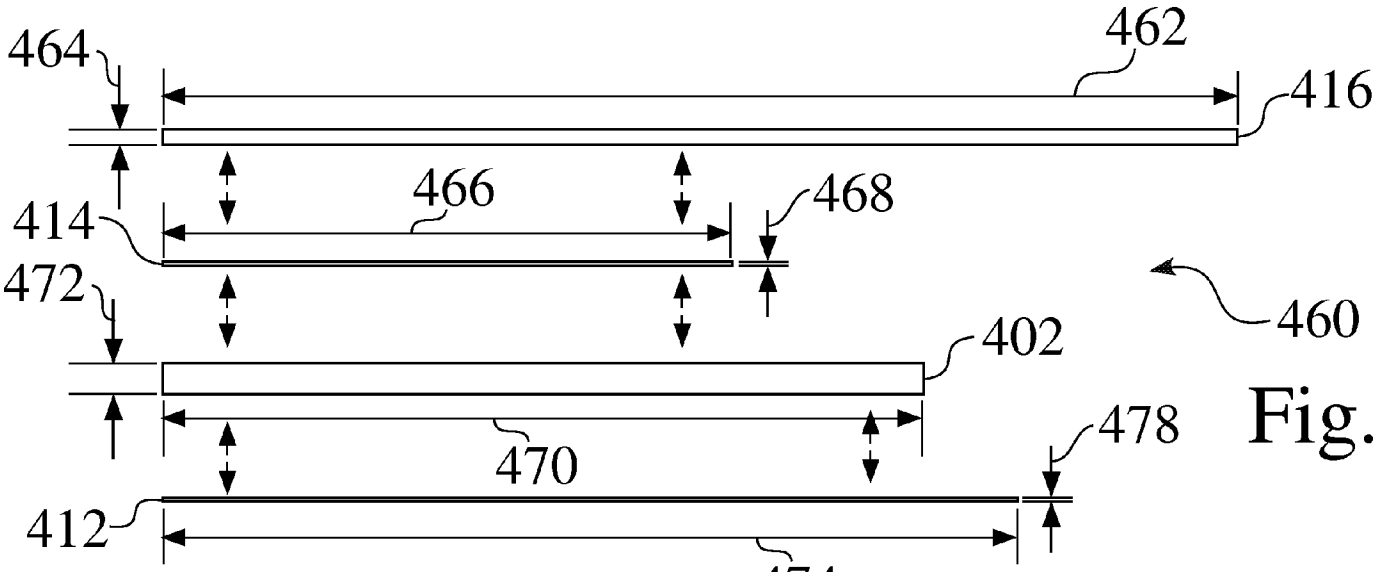
FIG. 13 is an expanded assembly view of an exemplary stress sensor having variable capacitance.
Figure 14:
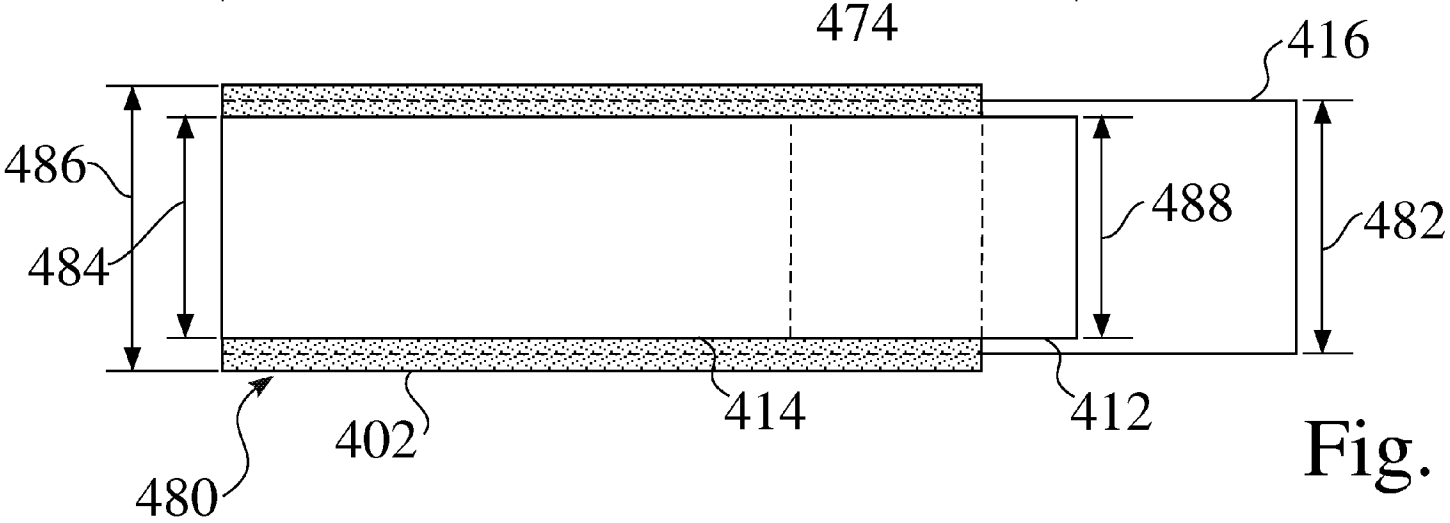
FIG. 14 is a plan view of layers associated with an exemplary stress sensor having variable capacitance.

FIG. 13 is an expanded assembly view 460 of an exemplary stress sensor 36 having variable capacitance 426. FIG. 14 is a plan view 480 of layers associated with an exemplary stress sensor having variable capacitance 426. The core layer 416 seen in to FIG. 13 and FIG. 14 may preferably comprise a semi rigid layer 416, such as having a length 462, a width 482, and a thickness 464. The inner conductive layer 414 seen in FIG. 13 and FIG. 14 may preferably comprise a compliant inner conductive layer 414, e.g. aluminized Mylar™, such as having a length 466, a width 484, and a thickness 468, e.g. a thickness 468 of 0.005 inches. The dielectric layer 402 seen in FIG. 13 and FIG. 14, may preferably comprise a compliant foam 402, such as having a length 470, a width 486, and a thickness 472. The outer conductive layer 412 seen in FIG. 13 and FIG. 14 may preferably comprise a compliant outer conductive layer 412, e.g. aluminized Mylar™, such as having a length 474, a width 488, and a thickness 478, e.g. a thickness 468 of 0.005 inches.

Figure 15:
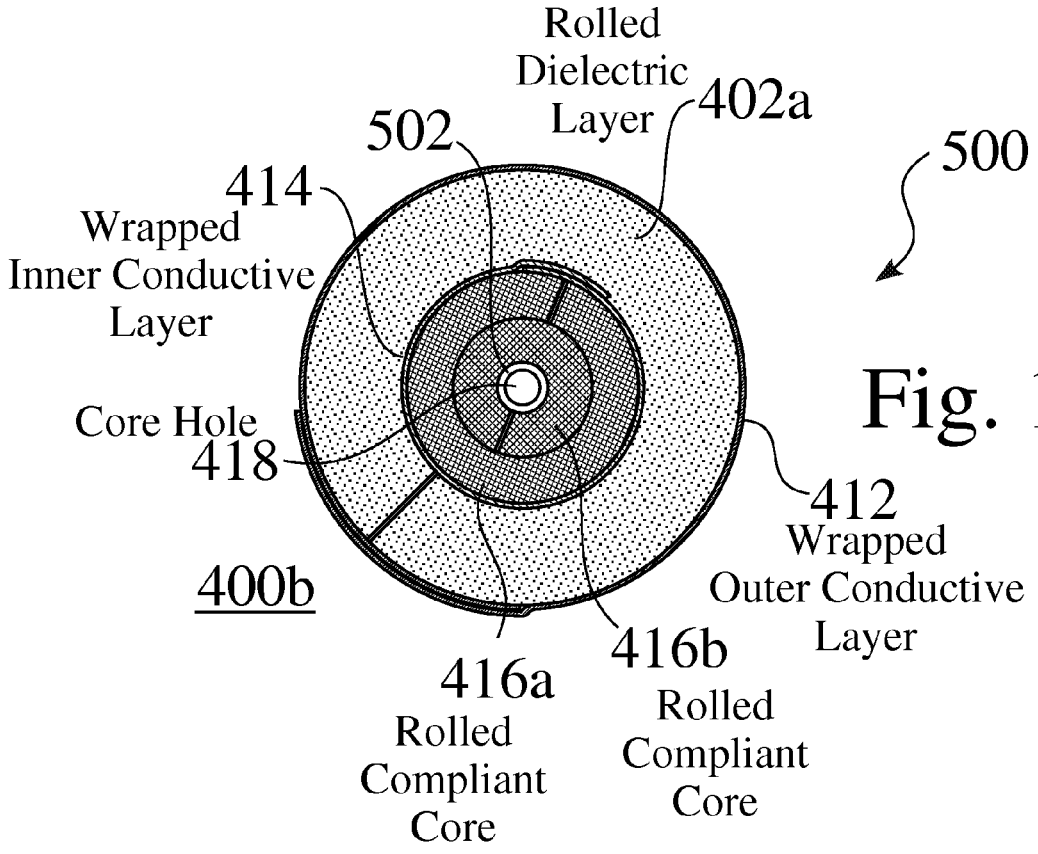
FIG. 15 is a schematic view of an exemplary stress sensor having variable capacitance, wherein the stress sensor comprises a rolled construction of one or more layers.

The capacitive stress sensor 400 seen in FIG. 13 and FIG. 14 may comprise flexible layers that are rollable or otherwise formed, such as about a compliant or solid core 416. For example, FIG. 15 is a schematic view 500 of an exemplary capacitive stress sensor 400*b* having variable capacitance 426, wherein the capacitive stress sensor 400*b* comprises a rolled construction of one or more layers. As seen in FIG. 15, one or more compliant core layers 416, e.g. 416*a*,416*b* form a generally cylindrical core, which may preferably further comprise an inner core element 502, such as having a core hole 418. An electrically conductive inner layer 414 may preferably be wrapped around the core 416. As well, one or more dielectric layers 402 may be wrapped around the inner electrically conductive inner layer 414, and an electrically conductive outer layer 412 may preferably be wrapped around the dielectric layer 402.

While some embodiments of capacitive stress sensors 400 resemble a cylinder, other embodiments of capacitive stress sensors 400 may resemble a wide variety of other shapes, such as but not limited to a rough cylinder, an oval, a rounded polygon, or even a hemisphere.

Figure 16:
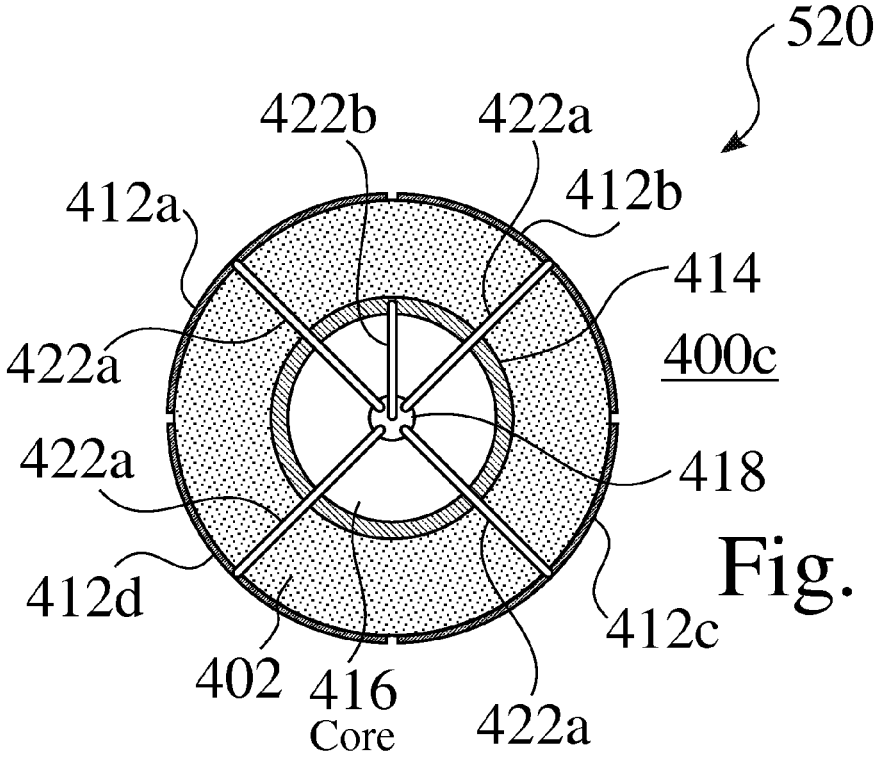
FIG. 16 is a schematic view of an exemplary stress sensor having variable capacitance, wherein the outer conductive layer comprises a plurality of plates.

For example, FIG. 16 is a schematic view 520 of an exemplary capacitive stress sensor 400*c* having variable capacitance 426, wherein the outer conductive layer 412 comprises a plurality of plates, e.g. 412*a*-412*d*. The exemplary capacitive stress sensor 400*b* seen in FIG. 16 also includes a single inner lead 422*b* connected to the inner conductive layer 414, and a plurality of outer leads 422*b* connected to respective outer conductive plates 412.

Figure 17:
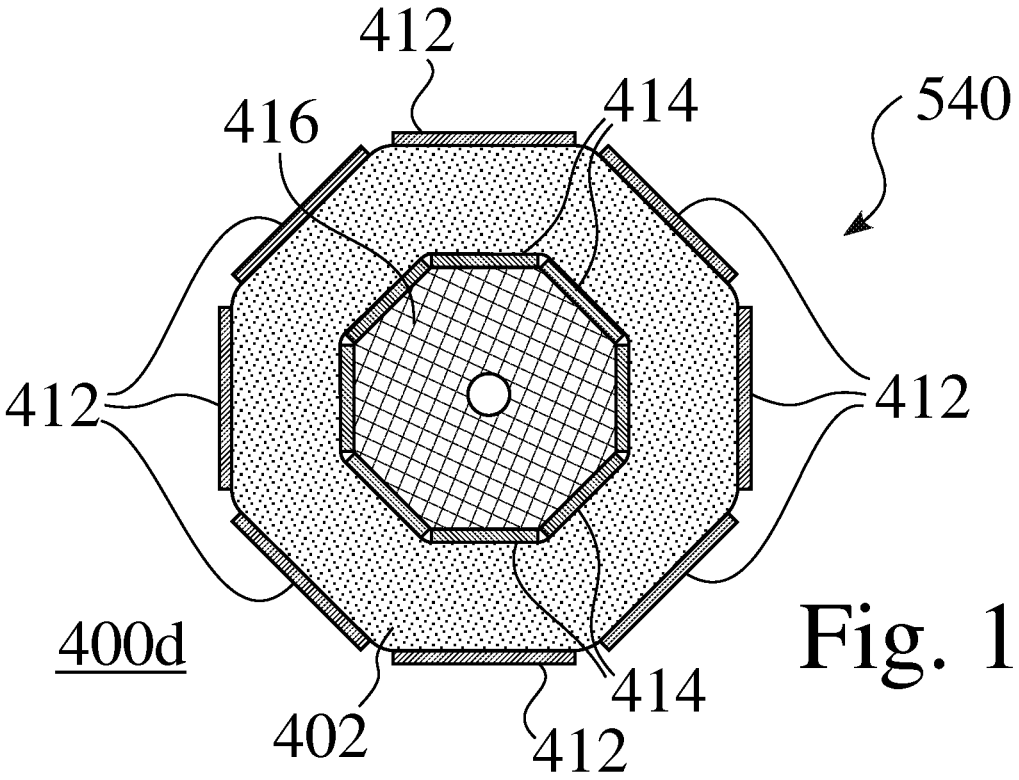
FIG. 17 is a schematic view of an exemplary stress sensor having variable capacitance, wherein the outer conductive layer comprises a plurality of flat plates.

FIG. 17 is a schematic view 540 of an exemplary capacitive stress sensor 400*d* having variable capacitance 426, wherein the outer conductive layer comprises a plurality of flat plates. For example, the inner core 416 seen in FIG. 17 comprises a generally polygonal shape, e.g. an octagon. Each of a plurality of inner conductive plates 414 are located on corresponding sides of the polygonal core 416. A generally matching polygonal dielectric layer 420 is located around the plurality of inner conductive plates 414, and a plurality of outer conductive plates 412 are located on corresponding sides of the polygonal dielectric layer 402.

Figure 18:
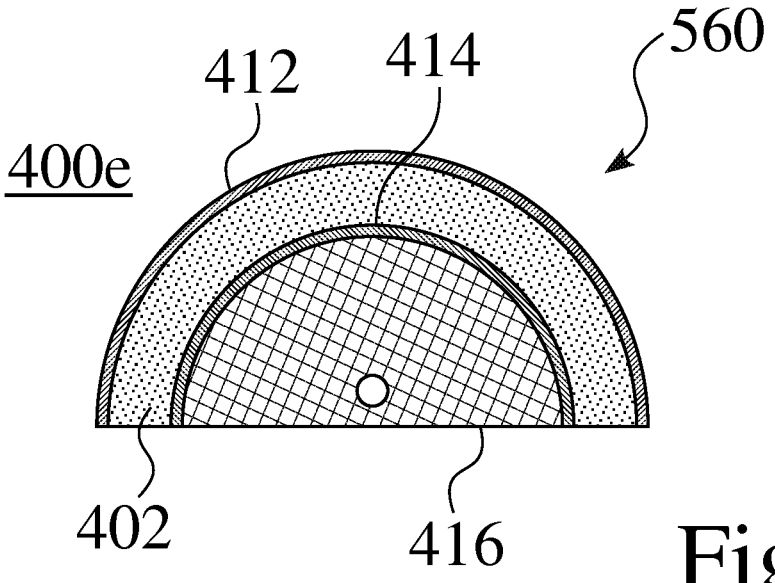
FIG. 18 is a schematic view of an exemplary arched stress sensor having variable capacitance.

FIG. 18 is a schematic view 560 of an exemplary arched, e.g. hemispherical, capacitive stress sensor 400*e* having variable capacitance 426. For example, an inner core 416 may comprise a hemispherical shape. A corresponding hemispherically shaped inner electrically conductive layer 414 may be located about the inner core 416. Similarly, a hemispherically shaped dielectric layer 402 is located about the inner electrically conductive layer 414, and a corresponding hemispherically shaped outer electrically conductive layer 412 may be located about the dielectric layer 402. For a capacitive stress sensor 400*e* having a geometry as seen in FIG. 18, the conductive layers 412,414 may preferably comprise flexible layers, such as the capacitive sensor 400*a* seen in FIG. 11, or may alternately comprise rigid hemispheres that compress or collapse in a concentric fashion.

One or more arched or hemispherically shaped capacitive stress sensor 400*e* may preferably be used in a wide variety of structures, such as but not limited to an enhanced musical toy, e.g. a train comprising a plurality of train cars corresponding to segments 16, wherein a user, e.g. a toddler, may hit one or more of the upwardly facing hemispherical sensors atop each car segment 16 with a hand or with a hammer, to produce a music loop 100.

Figure 19:
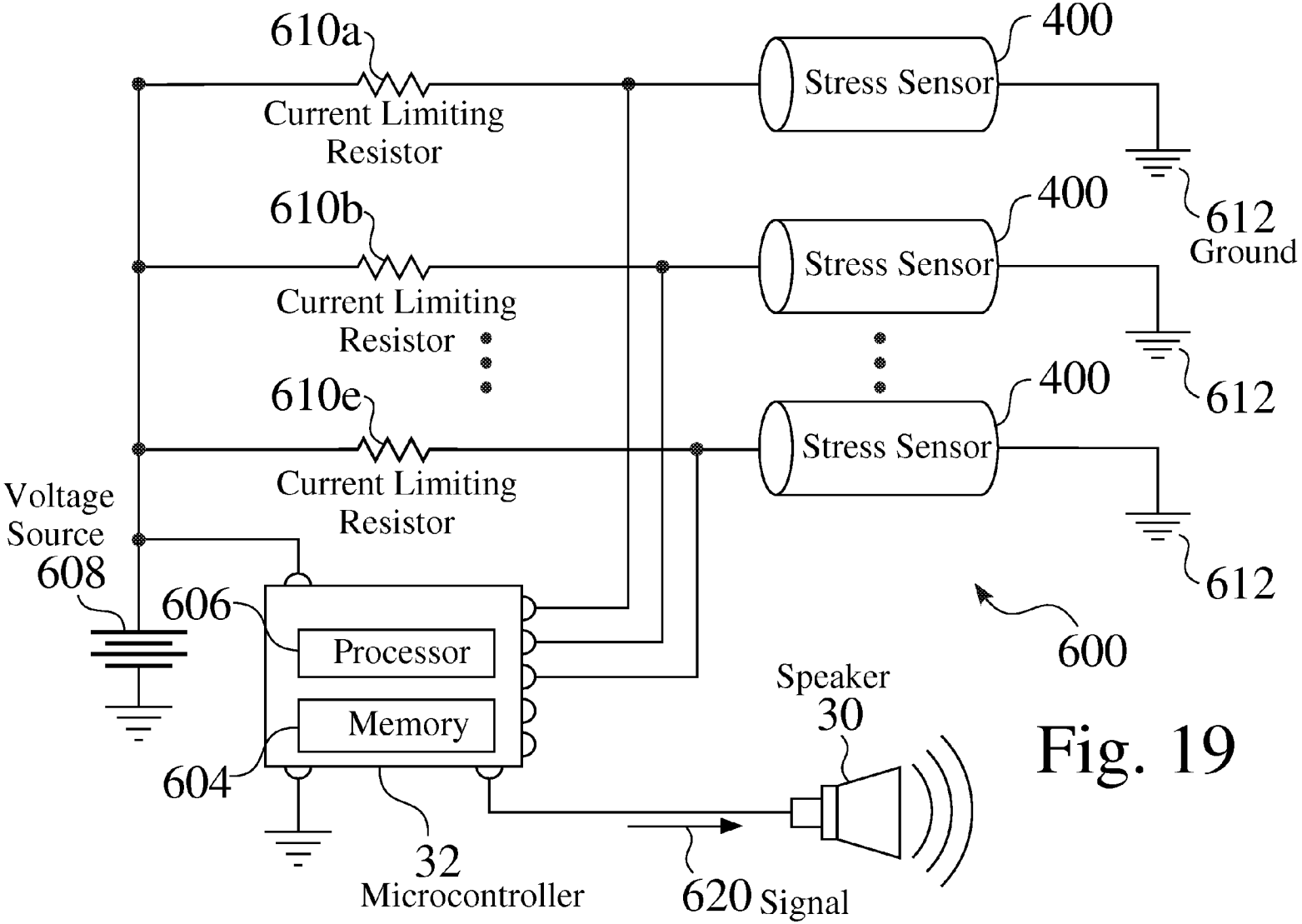
FIG. 19 shows an exemplary circuit diagram for a squeezable musical toy that is configured to produce sound as a function of user interaction through one or more stress sensors.

Exemplary Circuit Diagram. FIG. 19 shows an exemplary circuit diagram 600 for a squeezable musical toy 10 that is configured to produce a looping and decaying musical score 100 as a function of user interaction 38 through one or more capacitive stress sensors 400. As described above, the behavior of the enhanced toy 10 is controlled by a microcontroller 32. The microcontroller 32 typically comprises a processor 606 and memory 604, in which instructions, e.g. corresponding to the above pseudocode, and the audio samples 90 are stored. A voltage source 608 powers the processor 606. The voltage source 608 charges each of the capacitive stress sensors 400, via current limiting resistors 610, e.g. 610*a*-610*e*, respectively. An electrically conductive lead that extends from a point between each current limiting resistor 610, e.g. 610*a*, and its associated capacitive stress sensor 400, allows the microcontroller 32 to both monitor the voltage across each capacitive stress sensor 400, and control the charging and discharging of each capacitive stress sensor 400. The microcontroller 32 is connected to a speaker 30, for rendering the audio samples 90.

Also as described above, the exemplary toy seen in FIG. 1 periodically repeats the musical notes 82 activated as the user USR applies pressure 38 to one or more of the caterpillar segments 16, applying a decay factor to each note 82 upon repetition. It is therefore possible to characterize the musical behavior of the enhanced toy 10, with a decaying, looping score 100.

At each point in time, as the microcontroller 32 passes through the looping score 100, the microcontroller:

- analyzes the outputs from the stress sensors 36,400 to detect active stress sensors and instantiate new notes 82; and
- adds all currently active notes 82 to an audio output buffer.

For each sensor 36,400 that passes above a predetermined threshold, a new note 82 is created within the list of currently repeating notes with:

- a starting time equal to the current time within the looping score 100;
- a current amplitude 86 that is proportional to the maximum observed sensor amplitude;
- a reference to the audio sample 92 that corresponds to the active sensor 36,400; and
- a duration equal to the duration of the corresponding audio sample 92.

The new note 82 replaces the currently oldest note 82 within the list. The list of notes 82 thus stores notes 82 in a first-in-first-out manner, and at any time corresponds to the most recent set of notes 82 invoked by the user USR.

The microcontroller 32 then inspects each note 82 within the list of notes, specifically the starting time and duration, to determine if the current time within the looping score 100 intersects the note 82. If so, and the current amplitude 86 of the note 82 is above a predetermined threshold, the corresponding portion of the associated audio sample 92 is added to the audio output buffer at the current amplitude 86. Once the entire audio file has been added to the audio output buffer, the current amplitude 86 of the note 82 is attenuated by the decay factor, reducing the amplitude of the note 82 for the next pass through the looping score 100.

In some embodiments of the enhanced toy 10, one or more stress sensors 36 may preferably trigger additional responses, e.g. outside that of the decaying loop. For example, in the caterpillar shown in FIG. 1, a sixth segment 16*g* contains a stress sensor 36*g* that, upon measuring an applied pressure above a predetermined threshold, activates a vibration mechanism 650 (FIG. 20), such as comprising a rotating eccentric weight 40 in the tail 20. The vibration mechanism 40 may preferably remain active for as long as the applied pressure remains above a predetermined threshold.

FIG. 20 is a schematic diagram of a system 640 that is configured to determine changes in electrical capacitance 526 for one or more capacitive stress sensors 36, as a result of applied pressure 38.

In some exemplary embodiments, the system 640 is associated with an enhanced stuffed toy 10 (FIG. 1), wherein the system 640 may preferably determine the intensity with which a user USR applies a radial stress 38 to the toy 10.

While exemplary embodiments are disclosed herein in association with a stuffed toy 10, the system 640 may alternately be configured for a wide variety of alternate applications, such as but not limited any of exercise mechanisms or other toys.

As seen in FIG. 20, any of the microcontroller 32, the power source 608, the measurement mechanism 524, or the memory 604 may be internal to a structure associated with the body 12, such as within a stuffed toy 10. As also seen in FIG. 20, one or more actions 650, e.g. 650*a*-650*k*, are typically controllable through the microcontroller 32, and may be responsive to user interaction with the body 12.

Accordingly, although the invention has been described in detail with reference to a particular preferred embodiment, persons possessing ordinary skill in the art to which this invention pertains will appreciate that various modifications and enhancements may be made without departing from the spirit and scope of the claims that follow.

The invention claimed is:

1. A musical toy, comprising:
- an elongated stuffed animal having a body, the body comprising a plurality of segments;
- a plurality of stress sensors, wherein each of the stress sensors is within a corresponding segment,
- a microcontroller in communication with each of the stress sensors; and
- a speaker;
- wherein each of the sensors comprises any of a hemispherical, ellipsoidal, prismatic, or cylindrical shape;
- wherein each of the segments comprises padding enclosing one of the sensors, wherein the padding is an outer portion of the body segments;
- wherein the microcontroller is programmed to perform the steps of:
  - adding a musical note to a music loop comprising a repeating sequence of musical notes, wherein the musical note is based upon which of the plurality of sensors is activated, and
  - outputting the loop through the speaker; and
- wherein the microcontroller is further programmed to perform the step of applying a decay function to the music loop.

2. The musical toy of claim 1, wherein each of the stress sensors comprises a capacitor having a corresponding electrical capacitance having a value that increases as a function of pressure applied by a user.

3. The musical toy of claim 1, further comprising:
- a memory; and
- a plurality of audio samples stored within the memory, wherein each the audio samples corresponds to one of the musical notes;
- wherein the microprocessor is further programmed to perform the step of retrieving a respective one of the stored audio samples to add the musical note to the music loop.

4. The musical toy of claim 3, wherein each of the stored audio samples has a characteristic duration.

5. The musical toy of claim 1, wherein the initial amplitude of the musical note is proportional to the intensity with which the pressure is applied to a corresponding segment.

6. The musical toy of claim 1, wherein the microprocessor is further programmed to perform the step of ceasing repetition of a musical note if the amplitude of the musical note falls below a predetermined threshold.

7. A musical toy, comprising:
- an elongated stuffed animal having a body, the body comprising a plurality of segments;
- a plurality of stress sensors, wherein each of the stress sensors is within a corresponding segment,
- a microcontroller in communication with each of the stress sensors; and
- a speaker;
- wherein each of the sensors comprises any of a hemispherical, ellipsoidal, prismatic, or cylindrical shape;
- wherein each of the segments comprises padding enclosing one of the sensors, wherein the padding is an outer portion of the body segments;
- wherein the microcontroller is programmed to perform the steps of:
  - adding a musical note to a music loop comprising a repeating sequence of musical notes, wherein the musical note is based upon which of the plurality of sensors is activated, and
- outputting the loop through the speaker; and
- wherein the microprocessor is further programmed to perform the step of purging an oldest currently repeating note when adding a new note and the microprocessor has determined that the total number of currently repeating notes has reached a predetermined maximum number of notes.

8. The musical toy of claim 7, wherein each of the stress sensors comprises a capacitor having a corresponding electrical capacitance having a value that increases as a function of pressure applied by a user.

9. The musical toy of claim 7, further comprising:
- a memory; and
- a plurality of audio samples stored within the memory, wherein each the audio samples corresponds to one of the musical notes;
- wherein the microprocessor is further programmed to perform the step of retrieving a respective one of the stored audio samples to add the musical note to the music loop.

10. The musical toy of claim 9, wherein each of the stored audio samples has a characteristic duration.

11. The musical toy of claim 7, wherein the initial amplitude of the musical note is proportional to the intensity with which the pressure is applied to a corresponding segment.

12. The musical toy of claim 7, wherein the microprocessor is further programmed to perform the step of ceasing repetition of a musical note if the amplitude of the musical note falls below a predetermined threshold.

13. A musical toy, comprising:
- an elongated stuffed animal having a body, the body comprising a plurality of segments;
- a plurality of stress sensors, wherein each of the stress sensors is within a corresponding segment,
- a microcontroller in communication with each of the stress sensors; and
- a speaker;
- wherein each of the sensors comprises any of a hemispherical, ellipsoidal, prismatic, or cylindrical shape;
- wherein each of the segments comprises padding enclosing one of the sensors, wherein the padding is an outer portion of the body segments;

wherein the microcontroller is programmed to perform the steps of:

adding a musical note to a music loop comprising a repeating sequence of musical notes, wherein the musical note is based upon which of the plurality of sensors is activated, and outputting the loop through the speaker; and wherein the microprocessor is further programmed to perform the step of altering the tone or timbre of one or more of the musical notes.

14. The musical toy of claim 13, wherein each of the stress sensors comprises a capacitor having a corresponding electrical capacitance having a value that increases as a function of pressure applied by a user.

15. The musical toy of claim 13, further comprising:

a memory; and a plurality of audio samples stored within the memory, wherein each the audio samples corresponds to one of the musical notes;

wherein the microprocessor is further programmed to perform the step of retrieving a respective one of the stored audio samples to add the musical note to the music loop.

16. The musical toy of claim 15, wherein each of the stored audio samples has a characteristic duration.

17. The musical toy of claim 13, wherein the initial amplitude of the musical note is proportional to the intensity with which the pressure is applied to a corresponding segment.

18. The musical toy of claim 13, wherein the microprocessor is further programmed to perform the step of ceasing repetition of a musical note if the amplitude of the musical note falls below a predetermined threshold.

* * * * *